US010865540B2

(12) United States Patent
Smith et al.

(10) Patent No.: US 10,865,540 B2
(45) Date of Patent: Dec. 15, 2020

(54) GEOSYNTHETIC REINFORCED WALL PANELS COMPRISING SOIL REINFORCING MEMBERS

(71) Applicant: Tensar International Corporation, Alpharetta, GA (US)

(72) Inventors: Aaron D. Smith, Alpharetta, GA (US); Stephen D. Luptak, Alpharetta, GA (US); Jeremiah Riggio, Alpharetta, GA (US); Kord J. Wissmann, Alpharetta, GA (US)

(73) Assignee: Tensar International Corporation, Alpharetta, GA (US)

( * ) Notice: Subject to any disclaimer, the term of this patent is extended or adjusted under 35 U.S.C. 154(b) by 0 days.

(21) Appl. No.: 16/070,941

(22) PCT Filed: Feb. 2, 2017

(86) PCT No.: PCT/US2017/016165

§ 371 (c)(1),
(2) Date: Jul. 18, 2018

(87) PCT Pub. No.: WO2017/136518

PCT Pub. Date: Aug. 10, 2017

(65) Prior Publication Data

US 2019/0055712 A1 Feb. 21, 2019

Related U.S. Application Data

(60) Provisional application No. 62/290,258, filed on Feb. 2, 2016.

(51) Int. Cl.
*E02D 29/02* (2006.01)
*E02D 17/20* (2006.01)

(52) U.S. Cl.
CPC ..... *E02D 29/0241* (2013.01); *E02D 17/20* (2013.01); *E02D 29/0266* (2013.01);
(Continued)

(58) Field of Classification Search
CPC ..... E02D 17/20; E02D 17/205
See application file for complete search history.

(56) References Cited

U.S. PATENT DOCUMENTS 4,856,939 A 8/1989 Hilfiker
5,028,172 A * 7/1991 Wilson ..... E02D 29/0225 405/262

(Continued)

FOREIGN PATENT DOCUMENTS

FR 2921943 B1 10/2012
IN 2012/MU01712 A 6/2013
KR 2005054370 * 6/2005

*Primary Examiner* — Sean D Andrish
(74) *Attorney, Agent, or Firm* — E. Eric Mills; Nexsen Pruet, PLLC

(57) ABSTRACT

Geosynthetic reinforced wall panels including soil reinforcing members and retaining wall system formed therewith are disclosed. The geosynthetic reinforced wall panels include any type of wall panels, such as a precast concrete wall panels, that are supported by an arrangement of soil reinforcing members. Various configurations of soil reinforcing members may include end tabs and/or inner tabs that have strips arranged therebetween. Examples of soil reinforcing members include, but are not limited to narrow-width single-section reinforcing members, narrow-width multi-section reinforcing members, and wide-width reinforcing members. Further, a retaining wall system is provided that includes any arrangement of the one or more geosynthetic reinforced wall panels.

24 Claims, 24 Drawing Sheets

(52) U.S. Cl.
CPC .... *E02D 2250/00* (2013.01); *E02D 2300/002* (2013.01); *E02D 2300/0015* (2013.01); *E02D 2300/0084* (2013.01); *E02D 2600/00* (2013.01); *E02D 2600/20* (2013.01); *E02D 2600/30* (2013.01); *E02D 2600/40* (2013.01)

(56) References Cited

U.S. PATENT DOCUMENTS

| | | | | |
|---|---|---|---|---|
| 5,522,682 | A | 6/1996 | Egan et al. | |
| 5,564,865 | A | 10/1996 | Jansson | |
| 5,568,998 | A | 10/1996 | Egan et al. | |
| 5,823,709 | A | 10/1998 | Maher et al. | |
| 5,851,089 | A | 12/1998 | Beretta | |
| 5,911,539 | A | 6/1999 | Egan et al. | |
| 6,019,550 | A * | 2/2000 | Wrigley | E02D 29/0241 405/262 |
| 2002/0069605 | A1 * | 6/2002 | Hong | E02D 29/0241 52/660 |
| 2006/0204343 | A1 | 9/2006 | Kallen | |
| 2008/0267718 | A1 * | 10/2008 | Costin | E02D 29/0225 405/262 |
| 2016/0177533 | A1 * | 6/2016 | May | E02D 29/0241 405/262 |

* cited by examiner (FRONT VIEW)

(SIDE VIEW)

(PLAN VIEW)

(BACK VIEW)

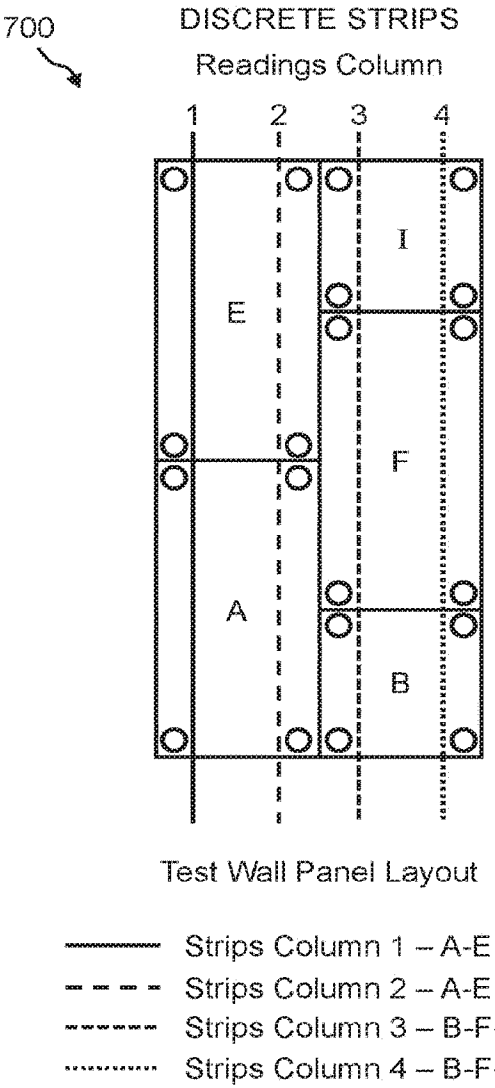
FIG. 23Ai
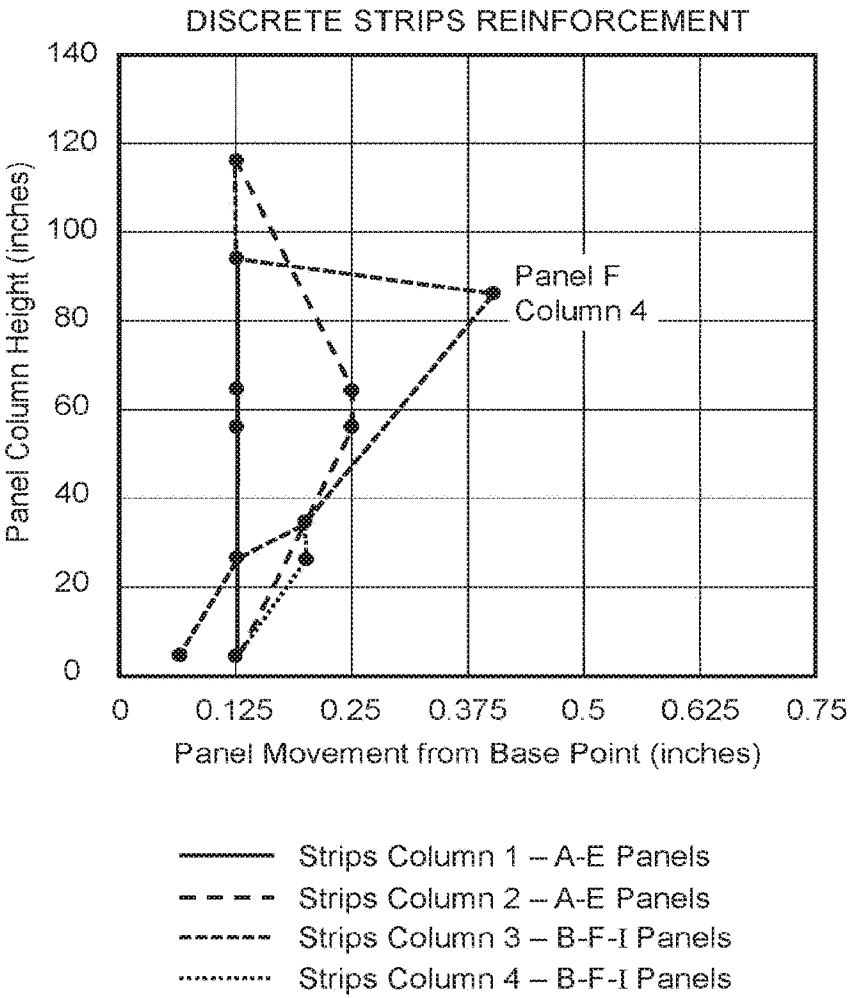
FIG. 23Aii

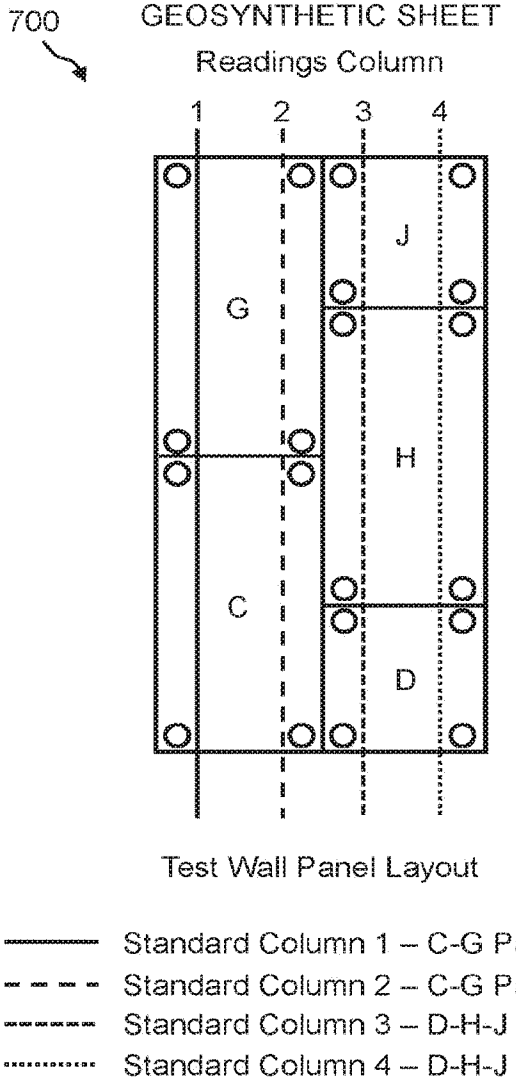
FIG. 23Bi
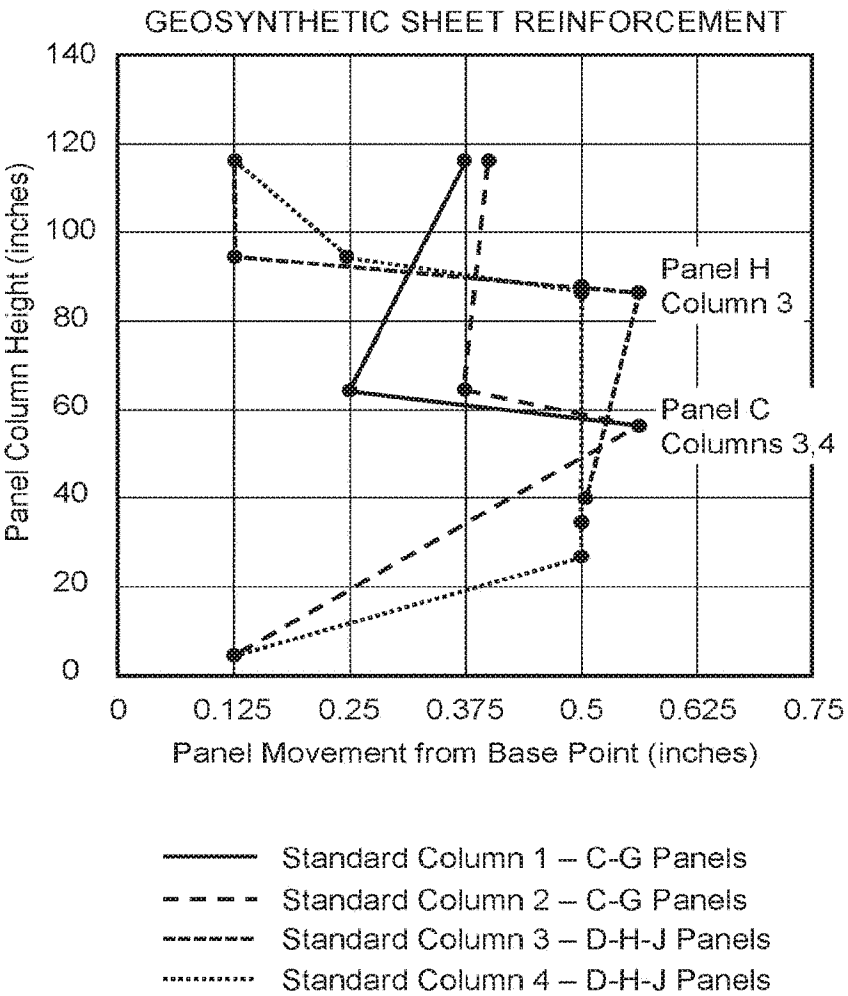
FIG. 23Bii

GEOSYNTHETIC REINFORCED WALL PANELS COMPRISING SOIL REINFORCING MEMBERS

CROSS REFERENCE TO RELATED APPLICATIONS

This application is a 35 U.S.C. § 371 U.S. national phase entry of International Application No. PCT/US2017/016165 having an international filing date of Feb. 2, 2017, which claims the benefit of U.S. Provisional Application No. 62/290,258 filed Feb. 2, 2016, each of which is incorporated herein by reference in its entirety.

TECHNICAL FIELD

The presently disclosed subject matter relates generally to the retention of earthen formations and more particularly geosynthetic reinforced wall panels comprising soil reinforcing members and retaining wall system formed therewith.

BACKGROUND

Retaining walls are commonly used for architectural and site development applications. Retaining walls have historically been constructed from mass concrete. More recently retaining walls are often constructed using systems of modular facades connected to soil reinforcing elements. Such soil reinforced earthen works are often called "Mechanically Stabilized Earth" structures and have now become a recognized civil engineering structure useful in the retention of hillsides, right of way embankments, and the like. The wall facing elements, which typically consist of masonry blocks, concrete blocks, concrete panels, or welded wire forms, are designed to withstand lateral pressures exerted by backfill soils. Reinforcement and stabilization of the soil backfill in mechanically stabilized earth applications is commonly provided using metallic or geosynthetic materials, such as geogrids or geotextiles that are placed horizontally in the soil fill behind the wall face. The reinforcing elements are connected to the wall face elements and interact with the soil to create a stable reinforced soil mass.

Wall facing elements most often consist of concrete masonry blocks or concrete panels. The use of both full height, as well as segmental variable height, pre-cast concrete wall panels for wall facing elements in a retaining wall is known, such as those disclosed in U.S. Pat. Nos. 5,568,998 and 5,580,191.

Metallic reinforcing elements comprised of steel and the like have the benefit that they exhibit a high tensile strength and are relatively easy to connect to the wall facing units. Because of their inherently high tensile strength, steel reinforcements often are comprised of discrete strips that are individually bolted to the facing panels. However, a drawback of metallic elements is that they can corrode and are thus not optimal in backfill materials that are aggressive to metals.

Geosynthetic reinforcing elements, typically comprised of polyester or high density polyethylene (HDPE), are also used for mechanically stabilized earth retaining structures. Like steel, reinforcing elements comprised of polyester are also subject to chemical attack and may degrade with time if unprotected. Although polyester materials typically are of relatively high tensile strength, they are not easily connected to wall facing panels and typically require a gravity "pinch" connection to the wall facing element. For this reason, and because of their vulnerability to chemical attack, polyester reinforcement is not preferred for panel wall reinforcement.

A preferred form of geosynthetic reinforcement is made by the process disclosed in U.S. Pat. No. 4,374,798 ("the '798 patent") using HDPE. The reinforcements are known as "integral geogrids". Integral geogrid material may be uniaxially oriented according to the '798 patent to provide grid-like sheets including a plurality of elongated, parallel, molecularly oriented strands with transversely extending bars integrally connected thereto by less oriented or unoriented junctions, the strands, bars and junctions together defining a multiplicity of elongated openings. HDPE materials are not susceptible to chemical attack and the high junction strength of the processed materials results in robust connections. However, HDPE is subject to creep deformations whereby this limitation results in a lower allowable tensile strength. For this reason, walls reinforced by HDPE use the full sheet width to develop sufficient tensile strength. Further, the connections between the panel face and reinforcement must be made along the entire panel width. This connection is not simple to employ in the field and results in connection "slack" that exists because the connections may be difficult to seat prior to loading the wall with the backfill soil.

An additional limitation to HDPE materials is that the full width of soil below the geogrid must be placed against the wall face prior to engaging the geogrid. This causes the wall to move outward away from the placed soil before the resistance of the grid can be engaged. The combination of the applied soil pressure and the connection slack results in panel walls that may displace laterally during construction, sometimes resulting in un-plumb and unsightly facades.

Regardless of the type of retaining wall system, the connection between the wall elements and the grid-like reinforcing sheet material remains of critical importance. As such, improvements in the art are desired to increase the efficiency in the connection system strength and thereby improve the stability of the retaining wall and the retained soil mass.

SUMMARY

The present disclosure relates generally to geosynthetic reinforced wall panels comprising soil reinforcing members and a retaining wall system formed therewith. In some embodiments, the retaining wall system may include: a retaining wall facing element, the retaining wall facing element comprising a plurality of embedded retaining wall connectors comprising discrete first geogrid sections; a plurality of tension connectors in communication with the embedded connector first geogrid sections; and a plurality of soil reinforcing members comprising discrete second geogrid sections in communication with the tension connectors.

The retaining wall facing element can be a precast concrete panel.

The embedded connector first geogrid sections and the soil reinforcing second geogrid sections can comprise a corrosion-resistant material that is substantially inert to chemical degradation, and the corrosion-resistant material that is substantially inert to chemical degradation can comprise HDPE.

The tension connectors can also comprise a corrosion-resistant material that is substantially inert to chemical degradation, or may comprise a bodkin connector, or a tubular connector.

The embedded connector first geogrid sections and soil reinforcing second geogrid sections can comprise multiple layers.

The system can further include a facing element stabilizing device comprising an angled corrugated section connected to the facing element to provide resistance to facing element rotation during backfill material placement. The facing element stabilizing device can be removably connected to the facing element through a bolted or pinned connection.

The system can further include a tensioning device for tensioning the embedded connector first geogrid sections and the soil reinforcing second geogrid sections during backfill material placement, the tensioning device can include a main bar, a handle bar, and a tensioning bar.

In a further embodiment, the retaining wall system may include: a retaining wall facing element, the retaining wall facing element comprising an embedded retaining wall connector comprising a first continuous geogrid section; a plurality of tension connectors in communication with the embedded connector first continuous geogrid section; and a plurality of soil reinforcing members comprising discrete second geogrid sections in communication with the tension connectors.

A method for reinforcing a retaining wall component is also provided and includes: positioning a retaining wall facing element in a predetermined location, the retaining wall facing element comprising a plurality of embedded retaining wall connectors comprising discrete first geogrid sections; connecting the embedded connector first geogrid sections to a plurality of tension connectors; providing a plurality of soil reinforcing members comprising discrete second geogrid sections; connecting the embedded connector first geogrid sections to the soil reinforcing second geogrid sections via the tension connectors; placing an amount of backfill material onto the embedded connector first geogrid sections and the soil reinforcing second geogrid sections; and compacting the backfill material onto the embedded connector first geogrid sections and the soil reinforcing second geogrid sections.

The method can further include tensioning steps of providing a predetermined tensioning force to the soil reinforcing second geogrid sections and tensioning the embedded connector first geogrid sections and the soil reinforcing second geogrid sections. The tensioning steps can be conducted through the use of a tensioning device comprising a main bar, a handle bar, and a tensioning bar.

The method can further include stabilizing of the retaining wall facing element during the backfill material placement step through the use of a facing element stabilizing device that provides resistance to facing element rotation during backfill material placement.

In a further embodiment, a method for reinforcing a retaining wall component is also provided and includes: positioning a retaining wall facing element in a predetermined location, the retaining wall facing element comprising an embedded retaining wall connector comprising a first continuous geogrid section; connecting the embedded connector first continuous geogrid section to a plurality of tension connectors; providing a plurality of soil reinforcing members comprising discrete second geogrid sections; connecting the embedded connector first continuous geogrid section to the soil reinforcing second geogrid sections via the tension connectors; placing an amount of backfill material onto the embedded connector first continuous geogrid section and the soil reinforcing second geogrid sections; and compacting the backfill material onto the embedded connector first continuous geogrid section and the soil reinforcing second geogrid sections.

BRIEF DESCRIPTION OF THE DRAWINGS

Figure 1:
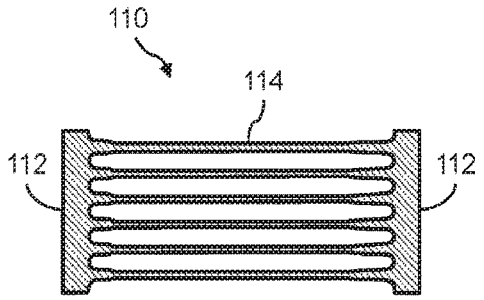
Figure 3:
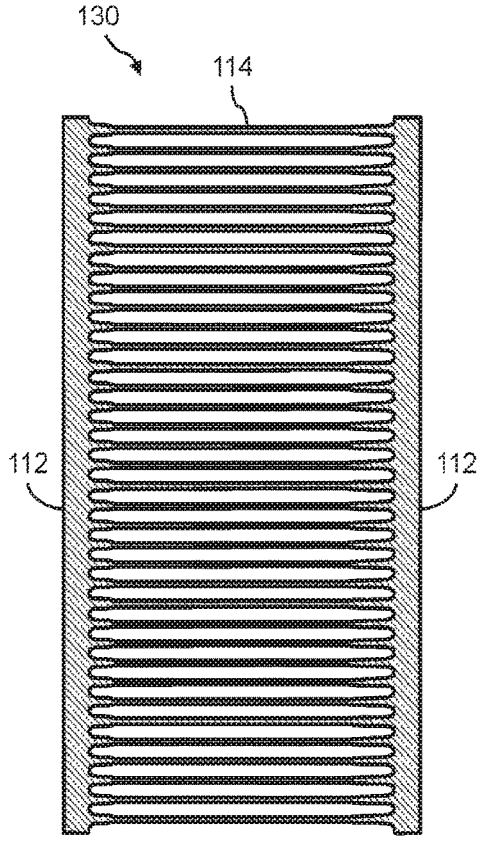
Figure 2:
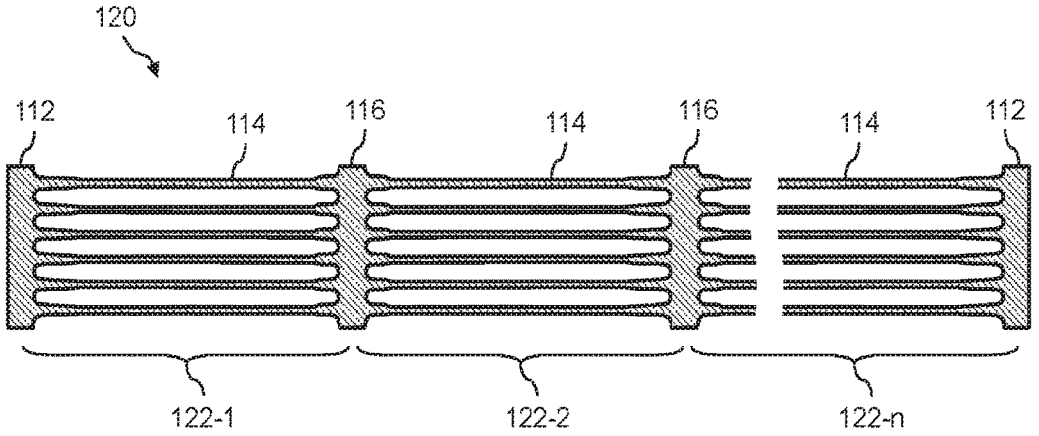
Figure 4A:
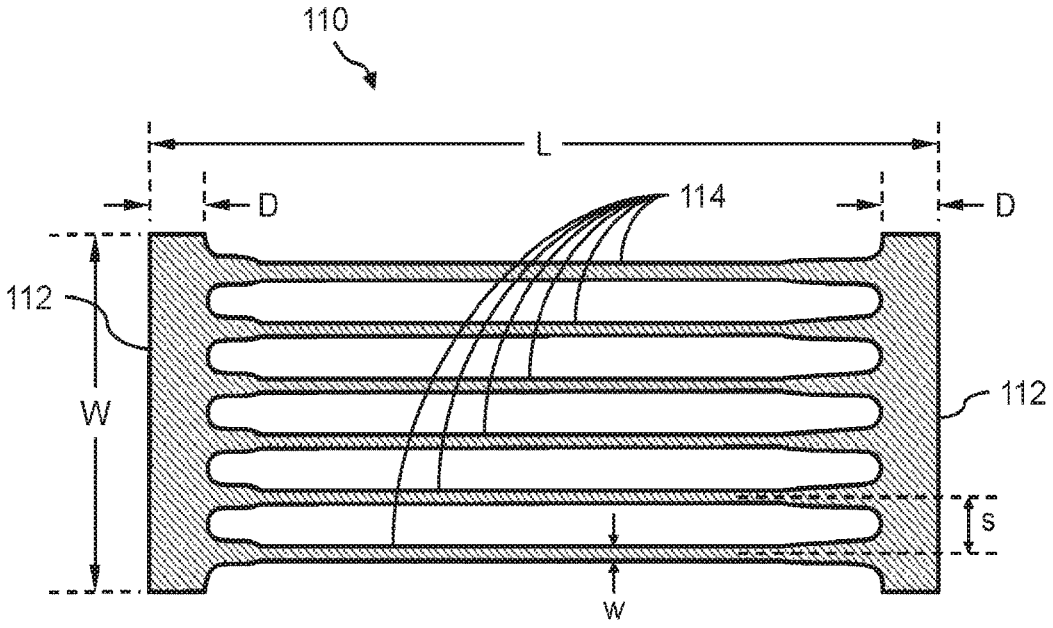
Figure 4B:
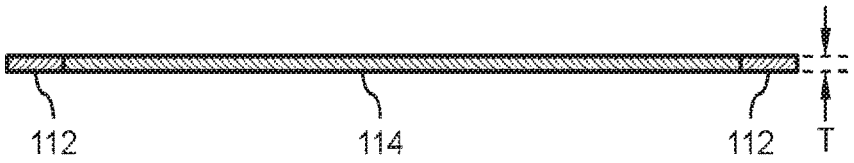
Figure 5:
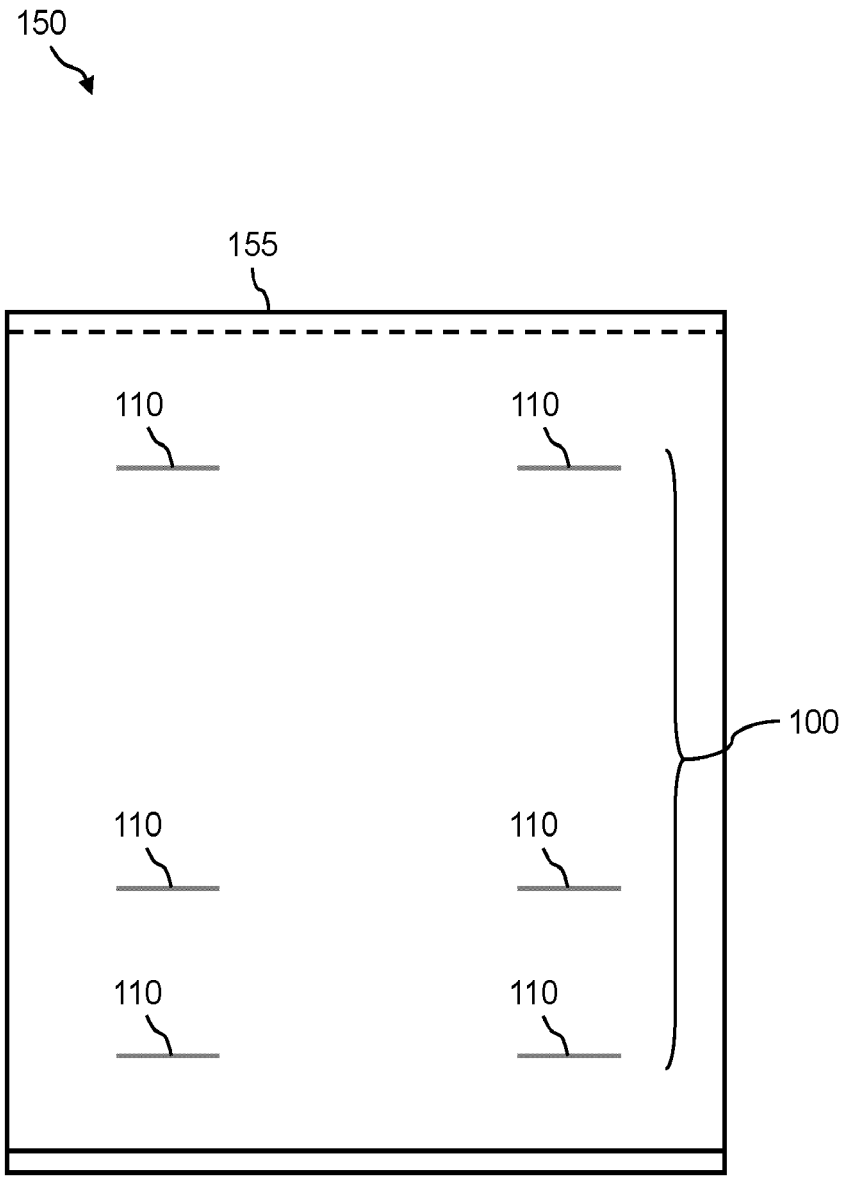
Figure 6:
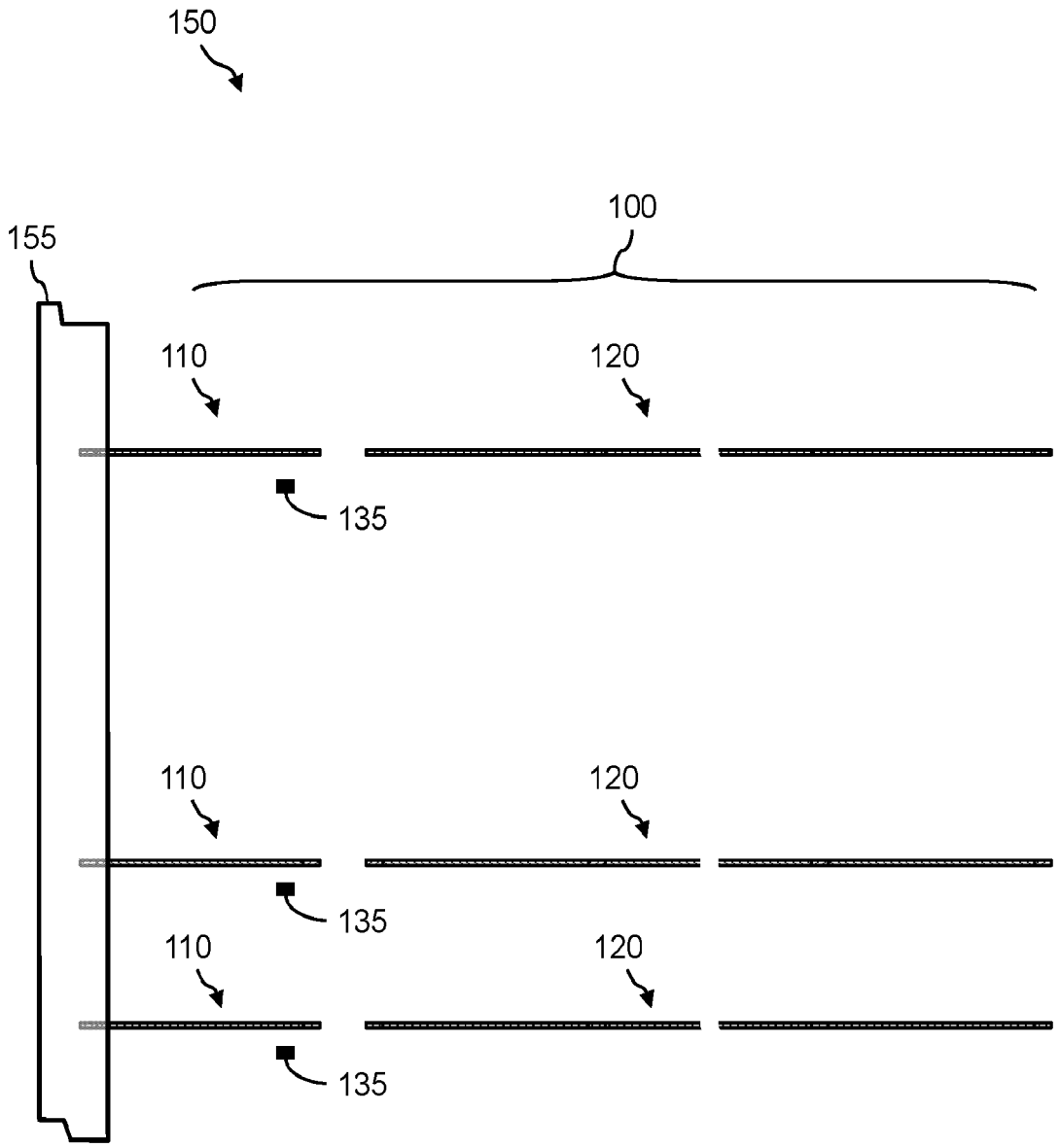
Figure 7:
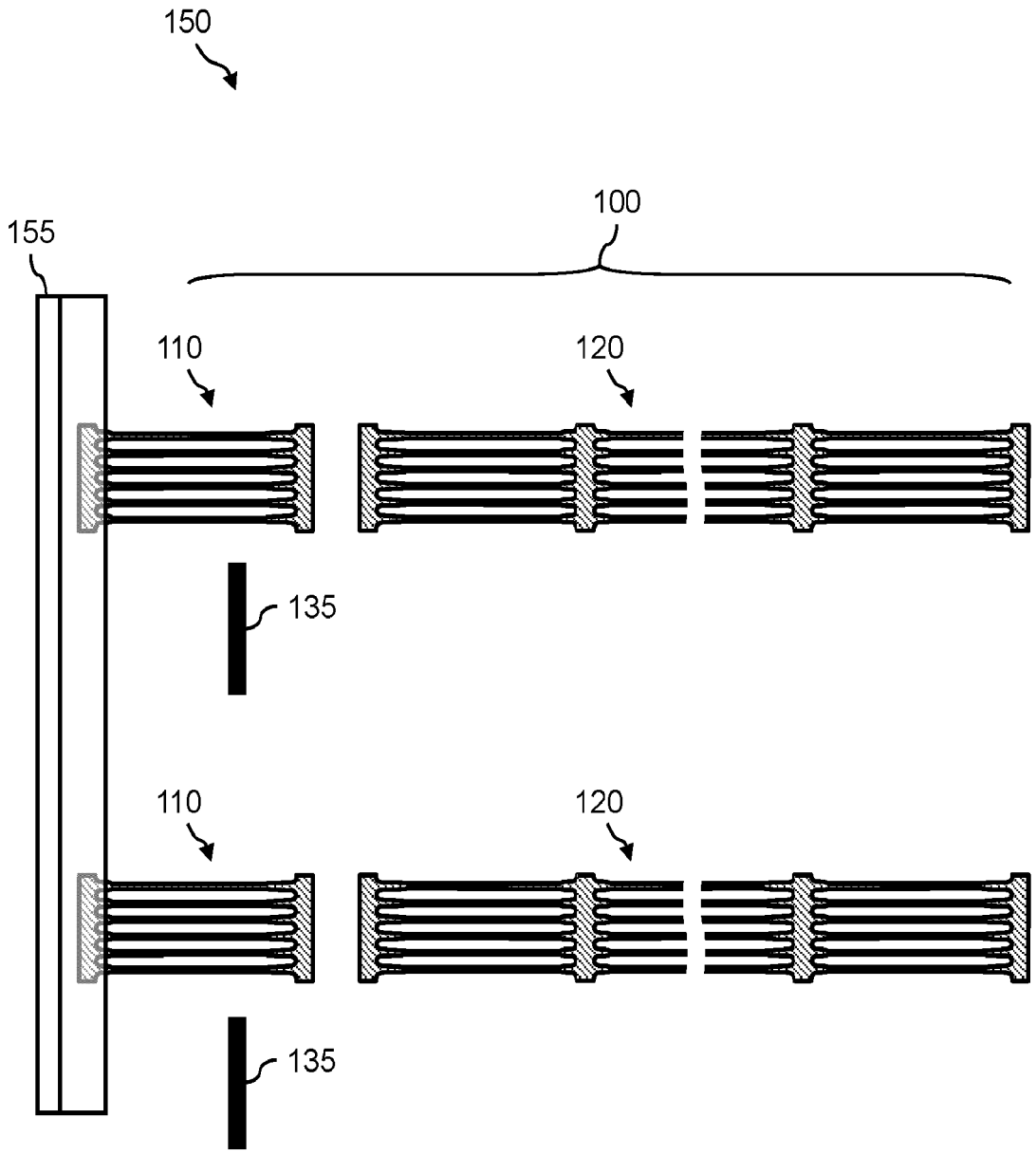
Figure 8:
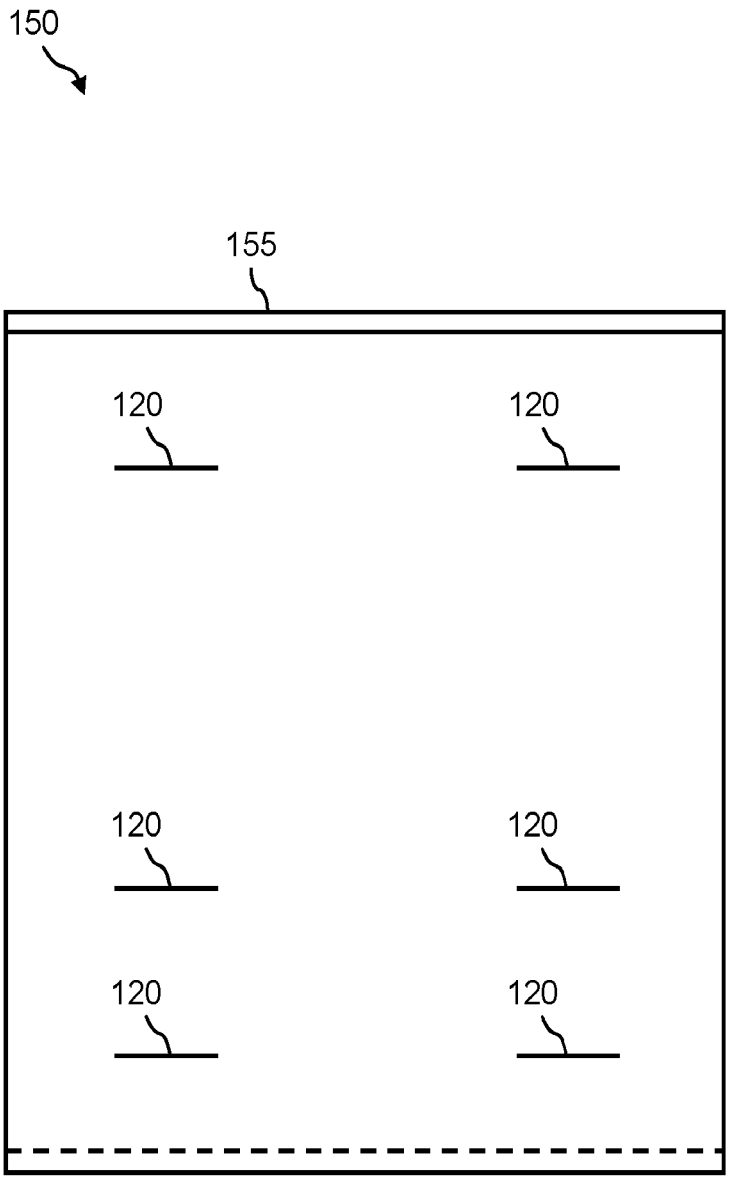
Figure 9A:
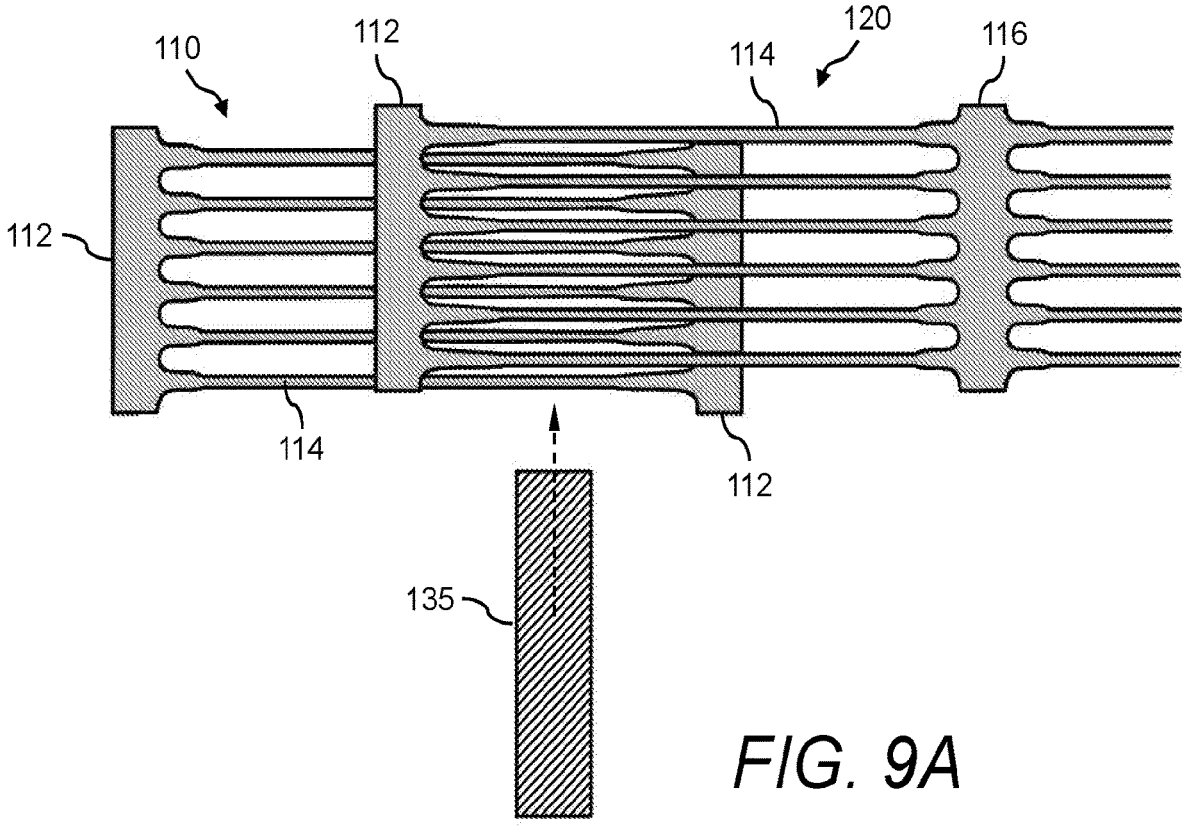
Figure 9B:
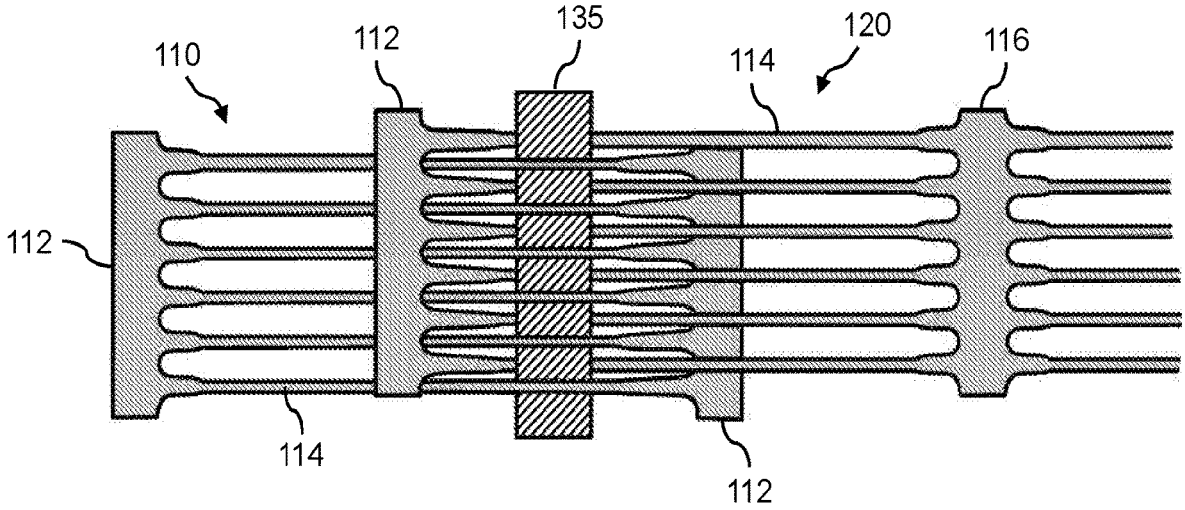
Figure 16:
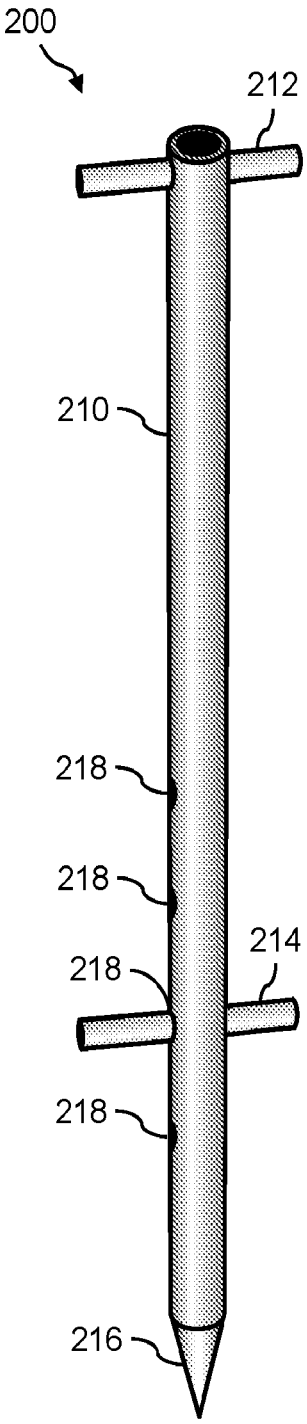
Figure 17A:
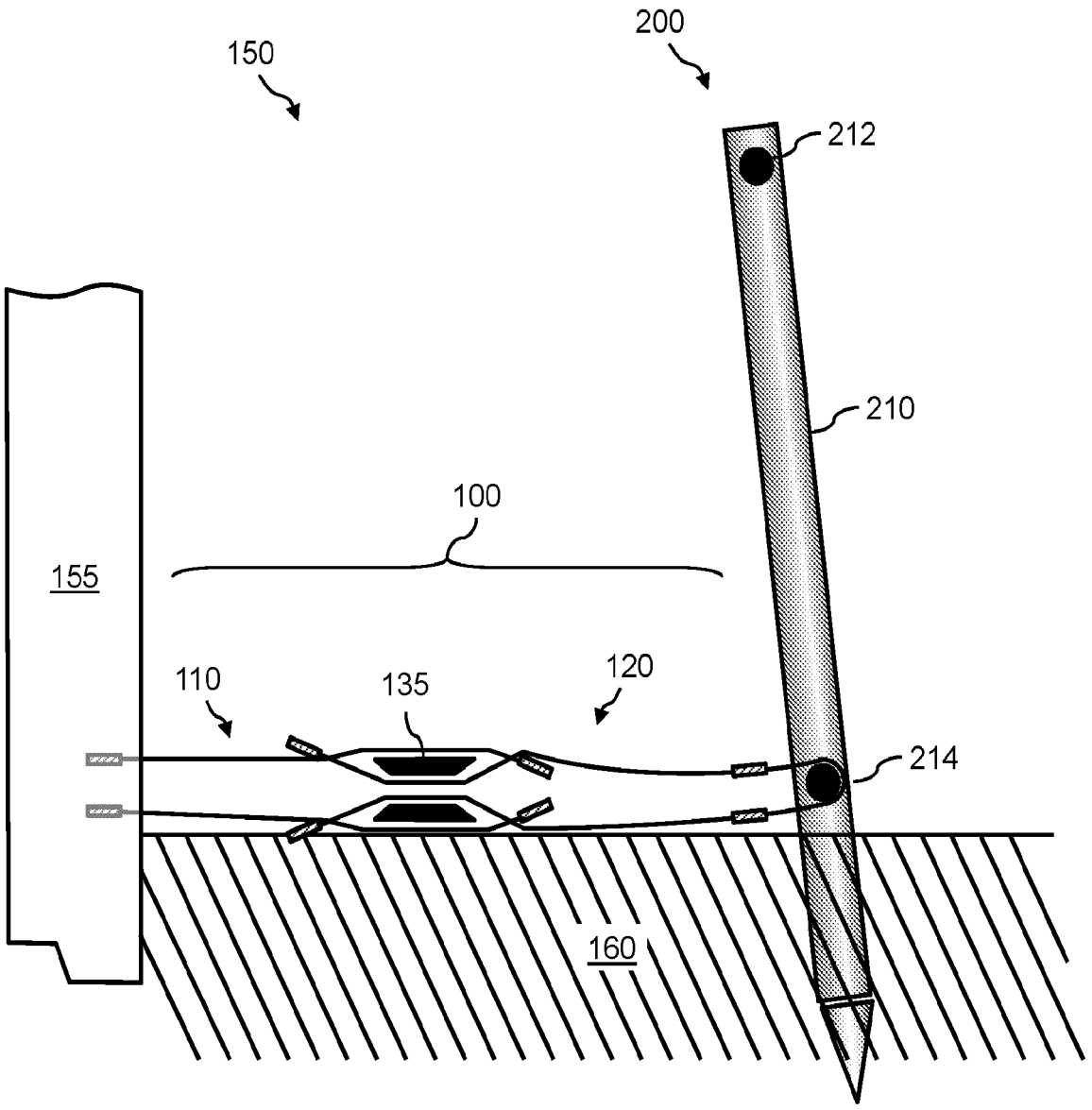
Figure 17B:
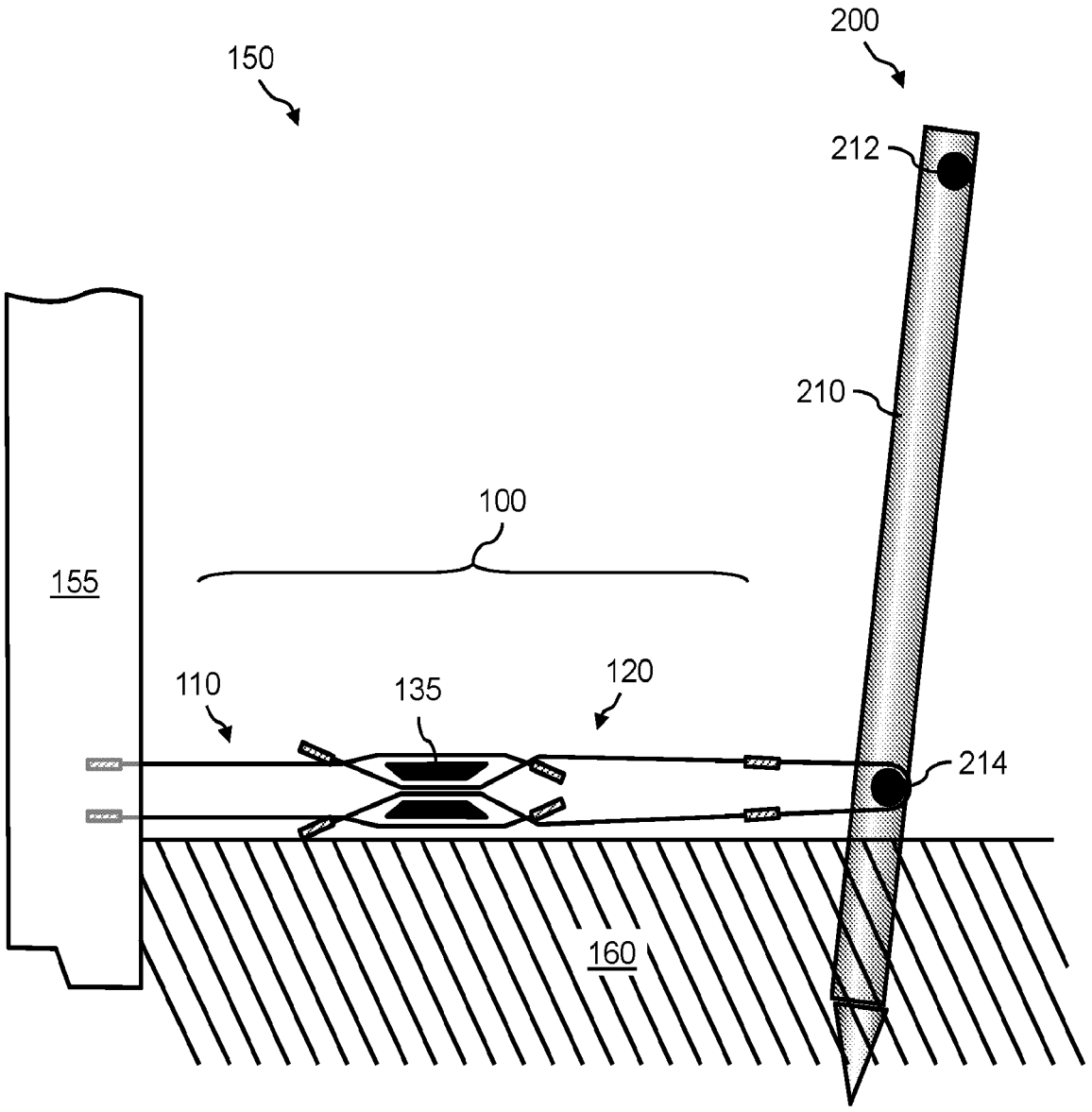
Figure 18:
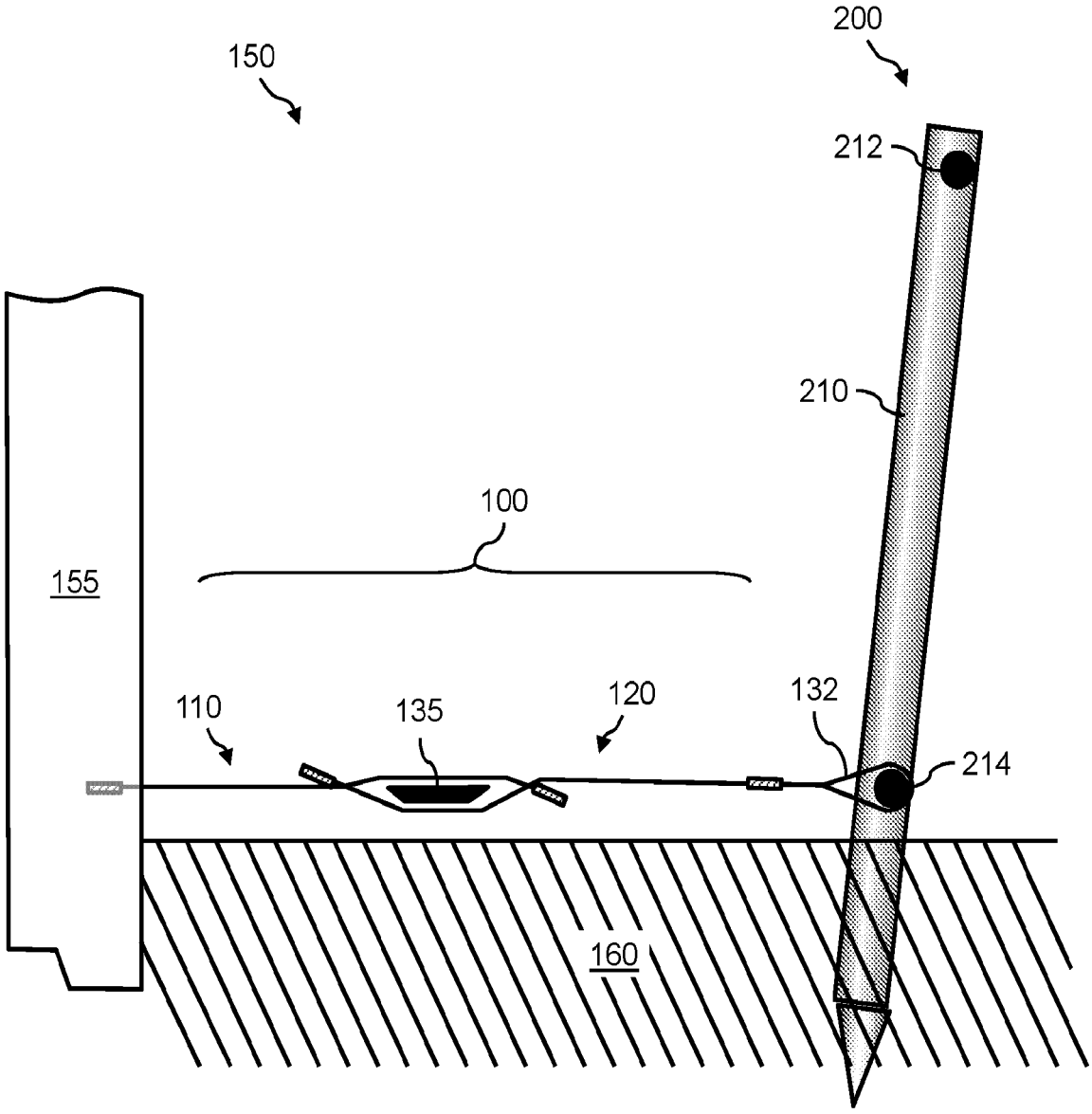
Figure 19A:
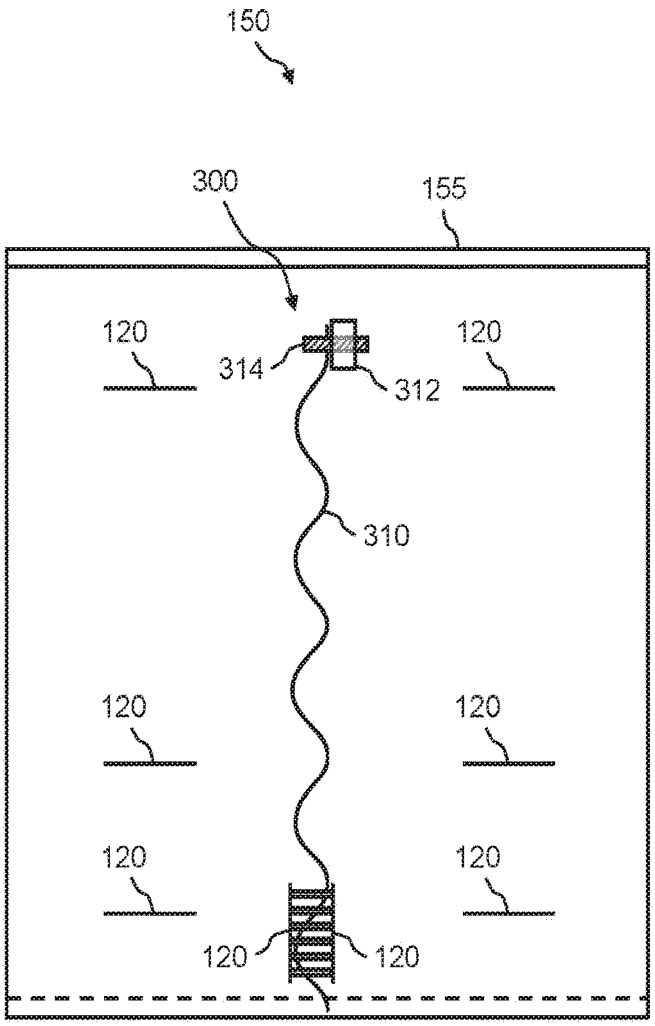
Figure 19B:
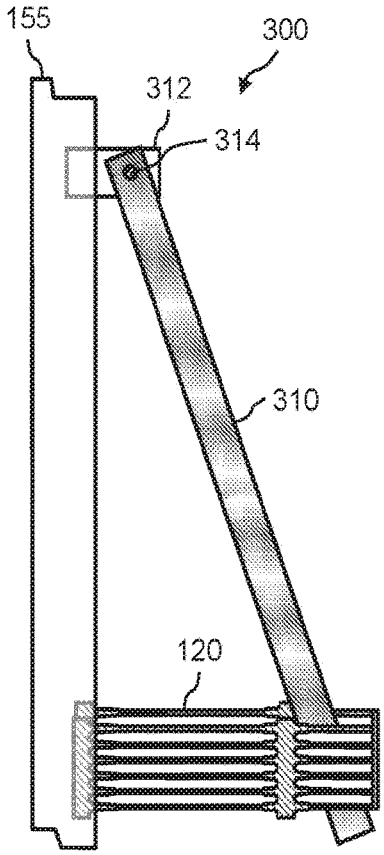
Figure 20:
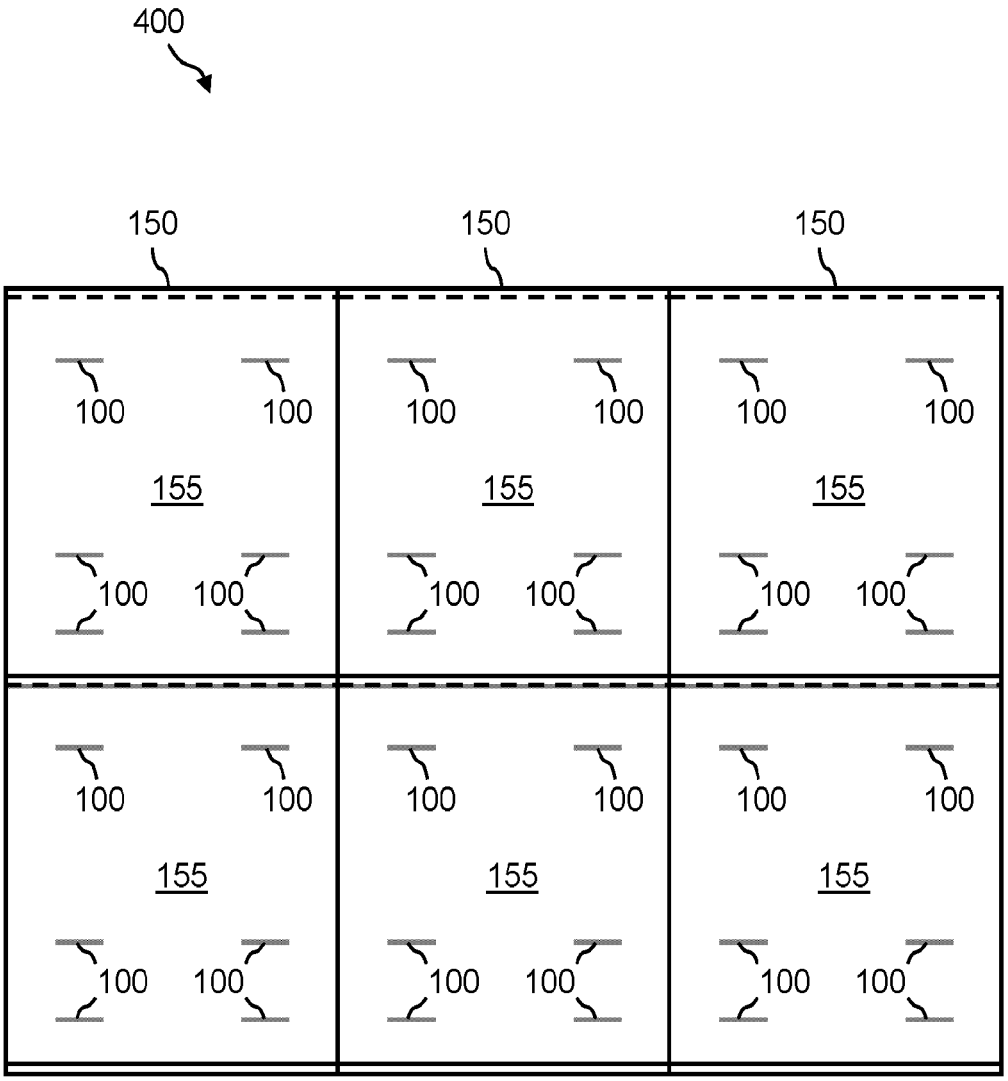
Figure 21:
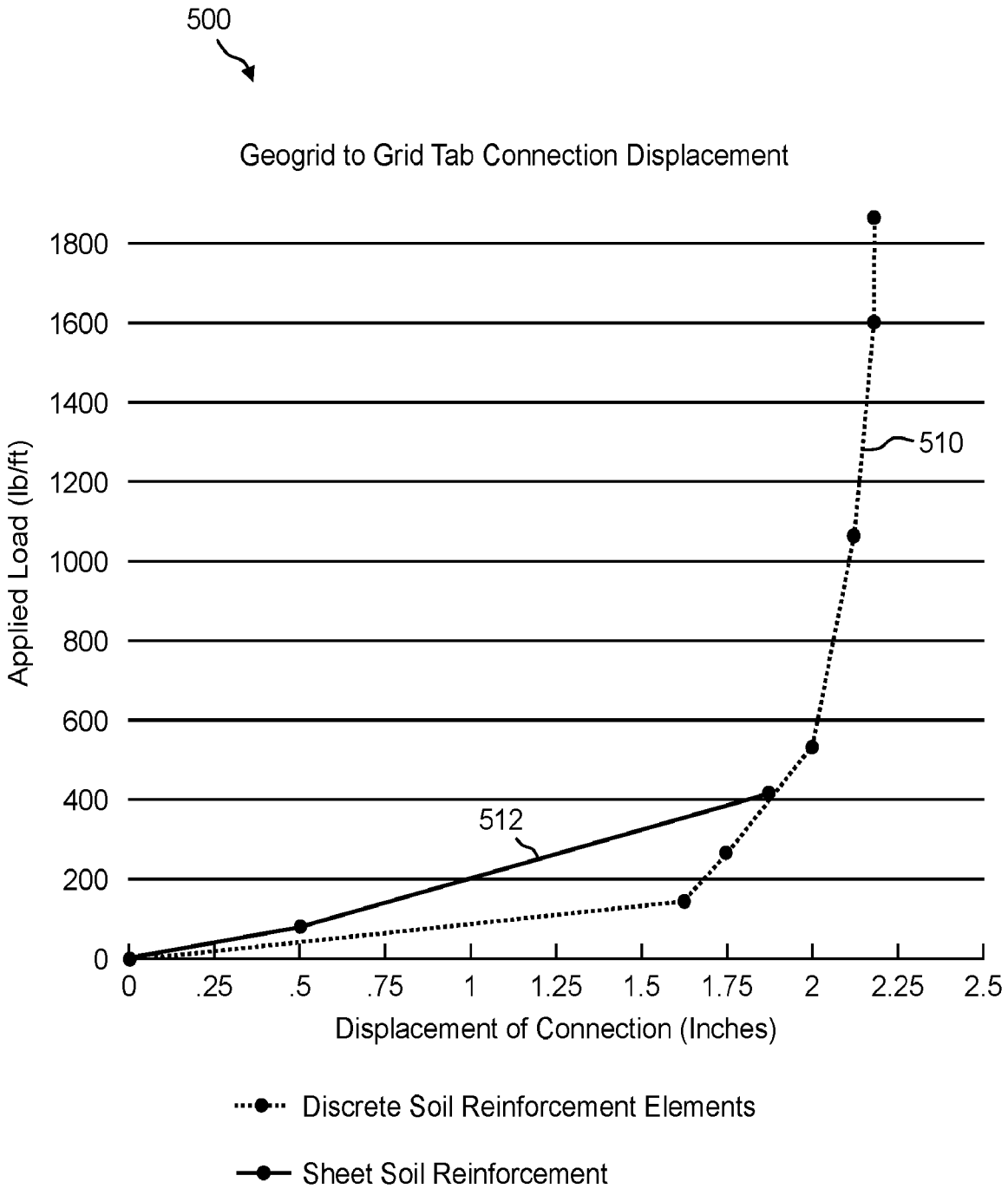
Figure 22B:
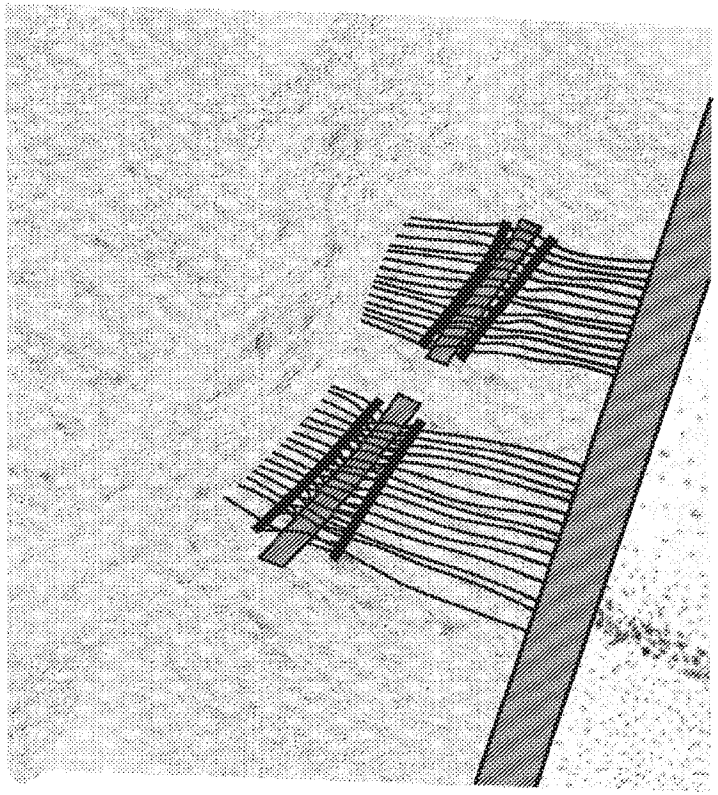
Figure 22A:
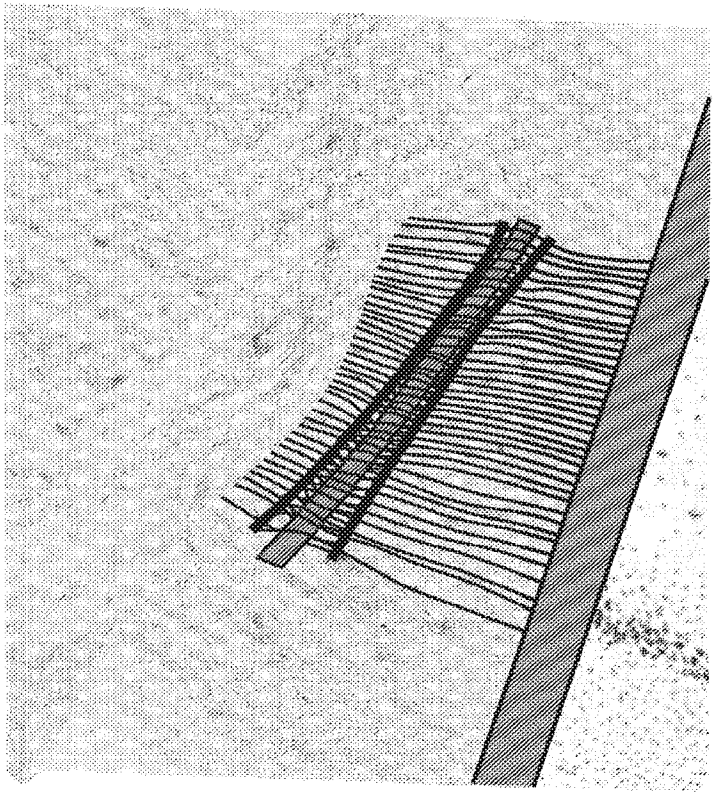
Figure 24:
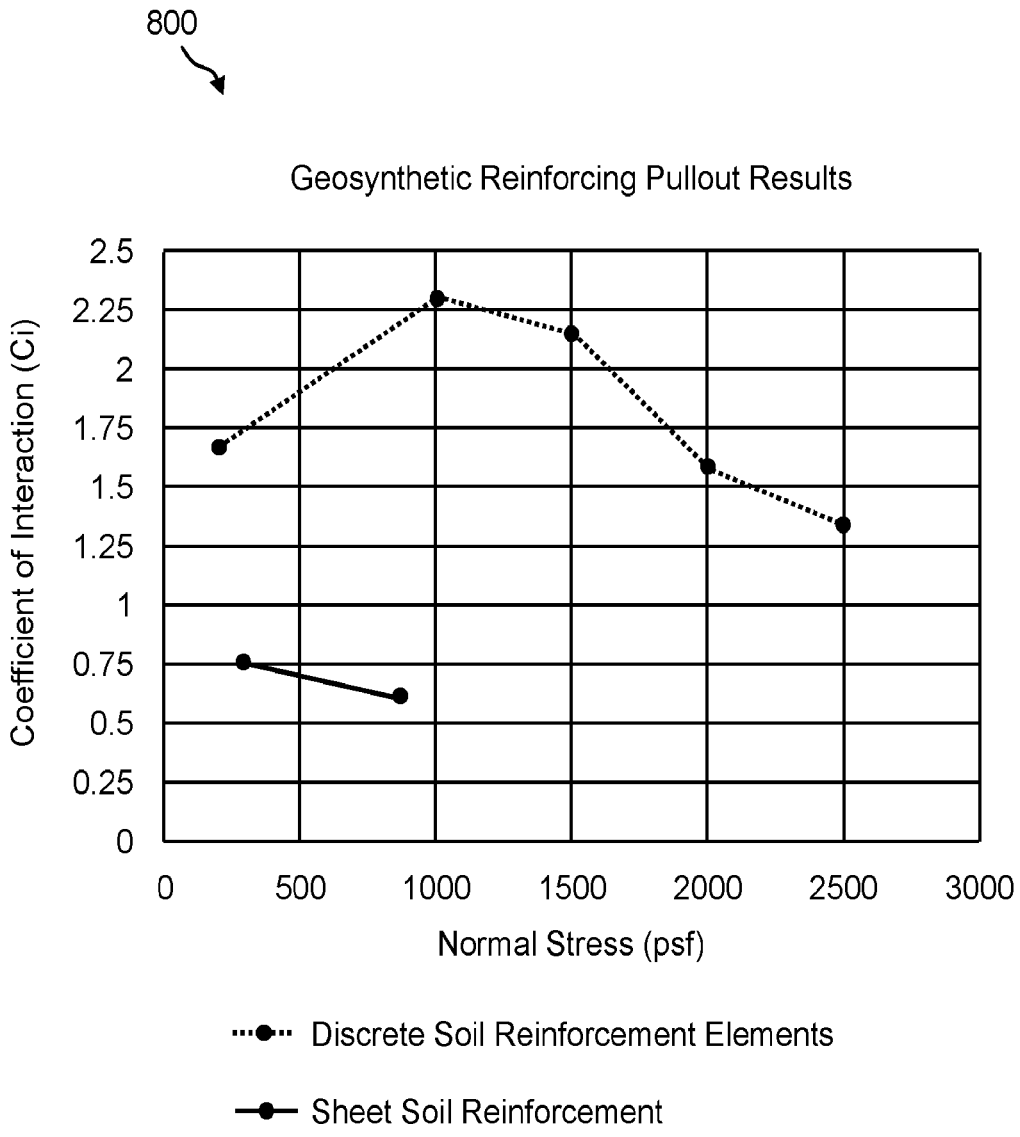

Having thus described the presently disclosed subject matter in general terms, reference will now be made to the accompanying drawings, which are not necessarily drawn to scale, and wherein:

FIG. 1, FIG. 2, and FIG. 3 illustrate plan views of examples of soil reinforcing members of the presently disclosed geosynthetic reinforced wall panels for building retaining walls;

FIGS. 4A and 4B illustrates a plan view and a side view, respectively, showing more details of the single-segment reinforcing member shown in FIG. 1;

FIG. 5, FIG. 6, FIG. 7, and FIG. 8 illustrate a front view, a side view, a plan view, and a back view, respectively, of an example of the presently disclosed geosynthetic reinforced wall panels for building retaining walls, wherein the panels may include the soil reinforcing members shown in FIG. 1, FIG. 2, and/or FIG. 3;

FIG. 9A and FIG. 9B show an example of a process of connecting one to another the soil reinforcing members of the presently disclosed geosynthetic reinforced wall panels;

FIG. 10, FIG. 11, FIG. 12, FIG. 13, FIG. 14, and FIG. 15 illustrate side views and a plan view of a portion of the presently disclosed geosynthetic reinforced wall panel and examples of multiple configurations for connecting the soil reinforcing members;

FIG. 16 illustrates a perspective view of an example of a tensioning device for use with the presently disclosed geosynthetic reinforced wall panels for building retaining walls;

FIG. 17A, FIG. 17B, and FIG. 18 illustrate side views of examples of using the tensioning device shown in FIG. 16;

FIGS. 19A and 19B illustrates a back view and side view, respectively, of the geosynthetic reinforced wall panel in combination with a corrugated panel stabilizing device;

FIG. 20 illustrates a front view of an example of a retaining wall system that includes any arrangement of one or more of the presently disclosed geosynthetic reinforced wall panels that are supported by any arrangement of soil reinforcing members;

FIG. 21 shows a plot indicating the results of laboratory testing that demonstrates the relative tightness or amount of "connection slack" removed using the soil reinforcing members of the presently disclosed geosynthetic reinforced wall panels;

FIGS. 22A and 22B shows illustrations showing a wide-width reinforcing member and discrete strips of soil reinforcing members installed for a test wall site;

FIGS. 23Ai, Aii, Bi and Bii show various plots indicating the results of a panel wall movement survey using full-width sheet soil reinforcing elements and walls built using the presently disclosed geosynthetic reinforced wall panels that include the soil reinforcing members; and FIG. 24 shows a plot indicating the Coefficient of Interaction (Ci) values of the two soil reinforcing types for comparison.

DETAILED DESCRIPTION

The presently disclosed subject matter now will be described more fully hereinafter with reference to the accompanying drawings, in which some, but not all embodiments of the presently disclosed subject matter are shown.

Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides geosynthetic reinforced wall panels comprising soil reinforcing members and retaining wall system formed therewith. Namely, the presently disclosed geosynthetic reinforced wall panels include any type of wall panels, such as a precast concrete wall panels, that are supported by any arrangement of soil reinforcing members.

Various configurations of soil reinforcing members may include end tabs and/or inner tabs that have strips arranged therebetween. Examples of soil reinforcing members include, but are not limited to, narrow-width single-section reinforcing members, narrow-width multi-section reinforcing members, and wide-width reinforcing members. The soil reinforcing members can be formed, for example, of high density polyethylene (HDPE) or polyethylene terephthalate (PET). The soil reinforcing members can be connected end-to-end via, for example, a Bodkin connection.

The soil reinforcing members (e.g., the narrow-width single-section reinforcing member, the narrow-width multi-section reinforcing member, and the wide-width reinforcing member) provide a robust connection to the geosynthetic reinforced wall panels and are designed to be engaged within the backfill prior to lateral pressure being placed against the geosynthetic reinforced wall panels. Further, the soil reinforcing members provide a high strength, substantially corrosion free, and simple and robust connection mechanism to geosynthetic reinforced wall panels. Further, soil reinforcing members provide means to form an HDPE geogrid with respect to geosynthetic reinforced wall panels.

Further, a retaining wall system is provided that includes any arrangement of one or more geosynthetic reinforced wall panels that are supported by any arrangement of soil reinforcing members.

Referring now to FIG. 1, FIG. 2, and FIG. 3 are plan views of examples of soil reinforcing members 100 of the presently disclosed geosynthetic reinforced wall panels 150 (see FIG. 5, FIG. 6, FIG. 7, and FIG. 8) for building retaining walls. For example, FIG. 1 shows a single-section reinforcing member 110, FIG. 2 shows a multi-section reinforcing member 120, and FIG. 3 shows a wide-width reinforcing member 130.

Single-section reinforcing member 110 typically includes two end tabs 112 and an arrangement of strips 114 therebetween. For example, the strips 114 are arranged in parallel fashion between the two end tabs 112. Single-section reinforcing member 110 is a high strength flat, thin, flexible member. Single-section reinforcing member 110 can be formed, for example, of HDPE or PET.

FIG. 4 shows more details of an example of the single-section reinforcing member 110 shown in FIG. 1. Namely, single-section reinforcing member 110 has a length L, a width W, and a thickness T. Each end tab 112 has a depth D. Single-section reinforcing member 110 includes, for example, six discrete strips 114 that have an on-center spacing s. Further, each strip 114 has a width w. Single-section reinforcing member 110 is not limited to six strips 114. The number of strips 114 can vary.

In this example that has six discrete strips 114, single-section reinforcing member 110 can have a length L of about 19-21 inches (480-535 millimeters) (and typically 8 inches (200 millimeters)), and a width W of about 7-9 inches (178-229 millimeters) (and typically 20 inches (510 millimeters)). Thickness T can vary along the length of the reinforcing member with a thickness T of about 0.106 inches (2.68 millimeters) to 0.29 inches (7.38 mm) at the end tab 112, and a thickness T of about 0.035 inches (0.88 millimeters) to 0.0906 inches (2.33 mm) at the strip 114. Each end tab 112 can have a depth D of about 1 inches (25 millimeters). The on-center spacing s of strips 114 can be about 0.63 inches (16 millimeters). Further, the width w of each strip 114 can be about 0.2 inches (135 millimeters).

Referring now again to FIG. 2, multi-section reinforcing member 120 includes any number of sections 122 (e.g., sections 122-1 through **122-*n*) arranged end-to-end to form a long-length reinforcing member. The features of each section 122 of multi-section reinforcing member 120 can be based on single-section reinforcing member 110 shown in FIG. 1 and FIG. 4. Multi-section reinforcing member 120 includes two end tabs 112 as well as multiple inner tabs 116 that define the sections 122**.

Single-section reinforcing member 110 of FIG. 1 and FIG. 4 and multi-section reinforcing member 120 of FIG. 2 can be considered "narrow-width" or "strip" soil reinforcing members, which means reinforcing members having a width W that is only a fraction of the width of the geosynthetic reinforced wall panels 150. By contrast, in "wide-width" reinforcing member 130 of FIG. 3, the width W can substantially approach the full width of the geosynthetic reinforced wall panels 150 (see FIG. 15). Namely, wide-width reinforcing member 130 of FIG. 3 is a single-section reinforcing member that is substantially the same as single-section reinforcing member 110 except for the number of strips 114 and the width W. That is, the number of strips 114 and the width W of wide-width reinforcing member 130 can be significantly greater than the number of strips 114 and the width W of single-section reinforcing member 110.

Soil reinforcing members 100 (e.g., single-section reinforcing member 110, multi-section reinforcing member 120, and wide-width reinforcing member 130) provide a robust connection to geosynthetic reinforced wall panels 150 and are designed to be engaged within the backfill prior to lateral pressure being placed against the geosynthetic reinforced wall panels 150. Further, soil reinforcing members 100 provide a high strength, substantially corrosion free, and simple and robust connection mechanism to geosynthetic reinforced wall panels 150. Further, soil reinforcing members 100 (e.g., single-section reinforcing member 110, multi-section reinforcing member 120, and wide-width reinforcing member 130) provide means to form an HDPE geogrid with respect to geosynthetic reinforced wall panels 150.

Soil reinforcing members 100 is not limited to single-section reinforcing member 110, multi-section reinforcing member 120, and wide-width reinforcing member 130 only. In particular, single-section reinforcing member 110, multi-section reinforcing member 120, and wide-width reinforcing member 130 can be available in any widths W and any lengths L. Further, other types and/or configurations of soil reinforcing members 100 are possible and are described hereinbelow. In one example, there may be certain variations in the features of single-section reinforcing member 110, multi-section reinforcing member 120, and wide-width reinforcing member 130 to suit particular functions.

Referring now to FIG. 5, FIG. 6, FIG. 7, and FIG. 8 is a front view, a side view, a plan view, and a back view, respectively, of an example of the presently disclosed geosynthetic reinforced wall panels 150 for building retaining walls, wherein geosynthetic reinforced wall panels 150 may include various soil reinforcing members 100 shown in FIG. 1, FIG. 2, and/or FIG. 3.

As an example, in geosynthetic reinforced wall panel 150 shown in FIG. 5, FIG. 6, FIG. 7, and FIG. 8, single-section reinforcing members 110 and multi-section reinforcing members 120 are used in combination with a wall panel 155. In one example, wall panel 155 can be a concrete panel. Single-section reinforcing members 110 and multi-section reinforcing members 120 are used to provide reinforcement to wall panel 155. Single-section reinforcing members 110 and multi-section reinforcing members 120 are located optimally for wall panel stability. In FIG. 5, FIG. 6, FIG. 7, and FIG. 8, multi-section reinforcing members 120 are shown not yet connected to single-section reinforcing members 110.

One end tab 112 of each of the single-section reinforcing members 110 is embedded into the precast concrete wall panel 155 sufficiently to develop panel pullout resistance. The end tab 112 of each of the single-section reinforcing members 110 that is not embedded into the concrete wall panel 155 can be connected to one end of a multi-section reinforcing members 120 using, for example, a Bodkin connection bar 135. For example, FIG. 9A and FIG. 9B show a process of connecting one end of multi-section reinforcing member 120 to one end of single-section reinforcing member 110. In this example, the respective ends of multi-section reinforcing member 120 and single-section reinforcing member 110 are overlapped and slightly offset from side-to-side so that their respective strips 114 can be interleaved. Once in this position, the strips 114 of multi-section reinforcing member 120 and the strips 114 of single-section reinforcing member 110 can both be flexed so that they interleave one another. For example, the strips 114 of single-section reinforcing member 110 can be bowed up through the spaces in multi-section reinforcing member 120. At the same time, the strips 114 of multi-section reinforcing member 120 can be bowed down through the spaces in single-section reinforcing member 110. Then, the Bodkin connection bar 135 can be inserted in the space between the strips 114 of multi-section reinforcing member 120 and the strips 114 of single-section reinforcing member 110. In so doing, multi-section reinforcing member 120 and single-section reinforcing member 110 are locked together. The connection is engaged when multi-section reinforcing member 120 is pulled tight laterally with respect to single-section reinforcing member 110. Because strips 114 are of relatively narrow width, the skew of the strips 114 has little to no influence when the Bodkin connection bar 135 is engaged. This type of connection is substantially absent of "slack" and provides greatly enhanced wall stiffness during construction.

Referring now to FIG. 10, FIG. 11, FIG. 12, FIG. 13, FIG. 14, and FIG. 15 is side views and a plan view of a portion of the presently disclosed geosynthetic reinforced wall panel 150 and examples of multiple configurations for connecting the soil reinforcing members 100.

Figure 10:
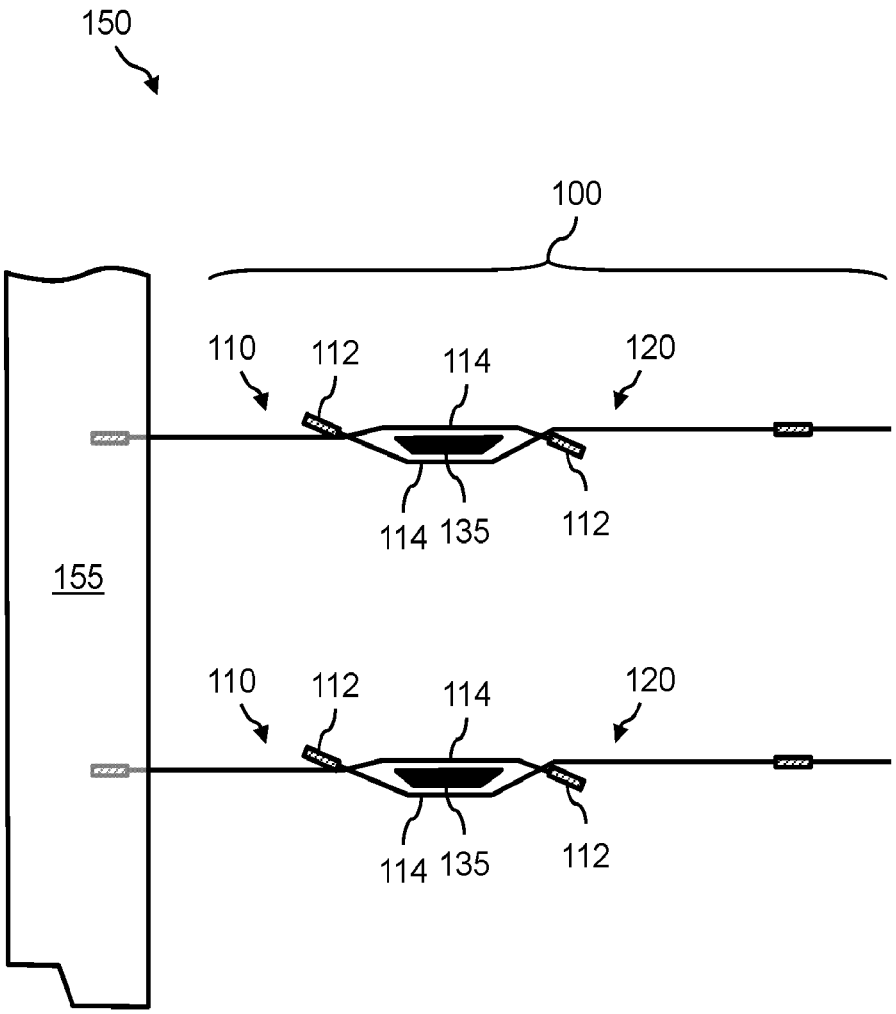

In one example, FIG. 10 shows a side view of a portion of geosynthetic reinforced wall panel 150 and examples of the connection shown in FIG. 9A and FIG. 9B. In this configuration, there is a single layer of reinforcement at two locations of geosynthetic reinforced wall panel 150.

Figure 11:
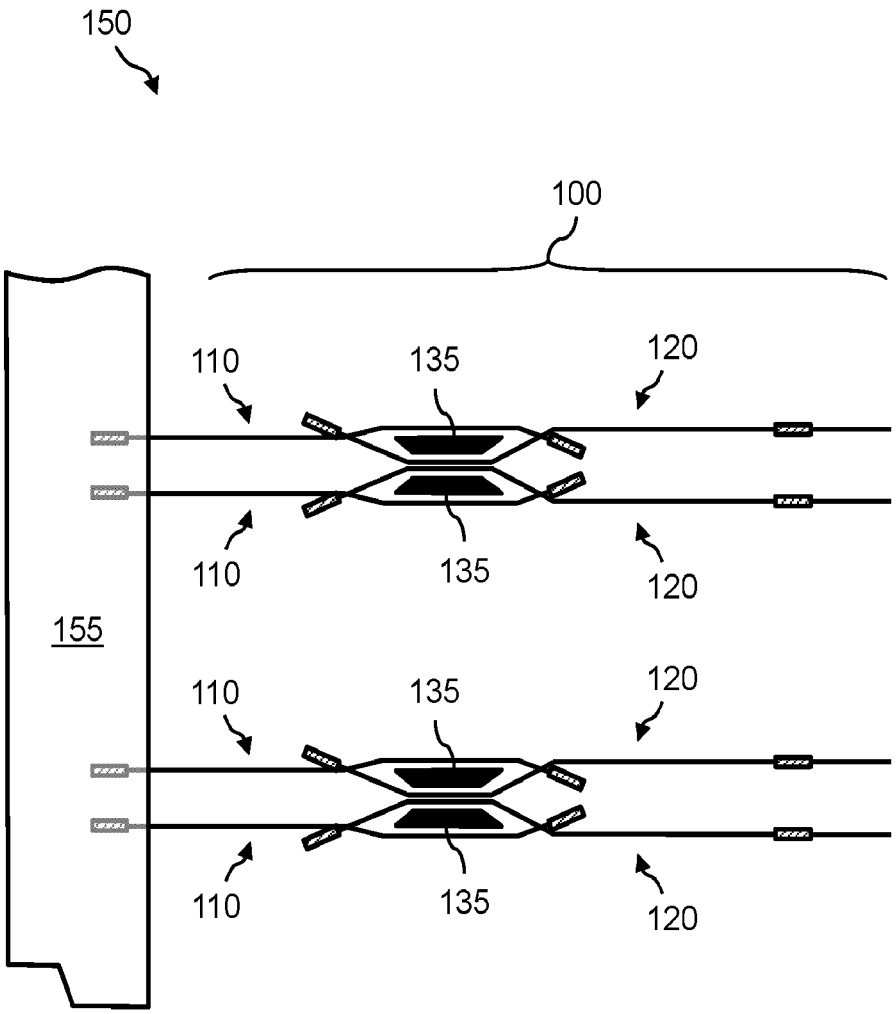

In another example, FIG. 11 shows multiple discrete soil reinforcing members 100 combined in a compound manner comprised of a double layer of reinforcement. The double layer of soil reinforcing members 100 enables the designer to utilize double layers of either a single soil reinforcing member 100 or two individual discrete soil reinforcing members 100, combined to provide an increased design strength and an increased pullout interaction in soil at a level greater than the individual layers themselves.

Figure 12:
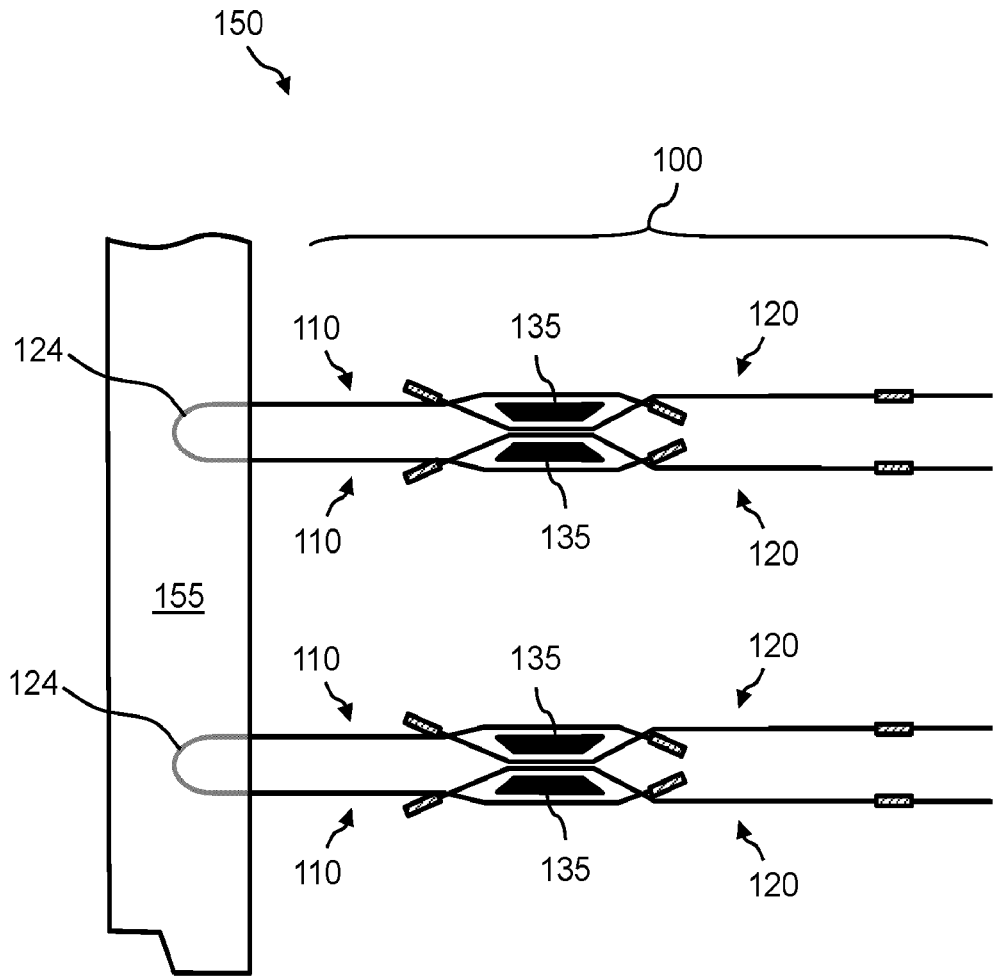

In yet another example, FIG. 12 shows that the double layer of discrete soil reinforcing members 100 may be connected to a singular looping tab section 124 that is cast into wall panel 155. The double layer of discrete soil reinforcing members 100 are then connected on each side with the Bodkin connection bar 135 as shown in FIG. 12. A singular looping tab section 124 may be preferable for economic reasons.

Figure 13:
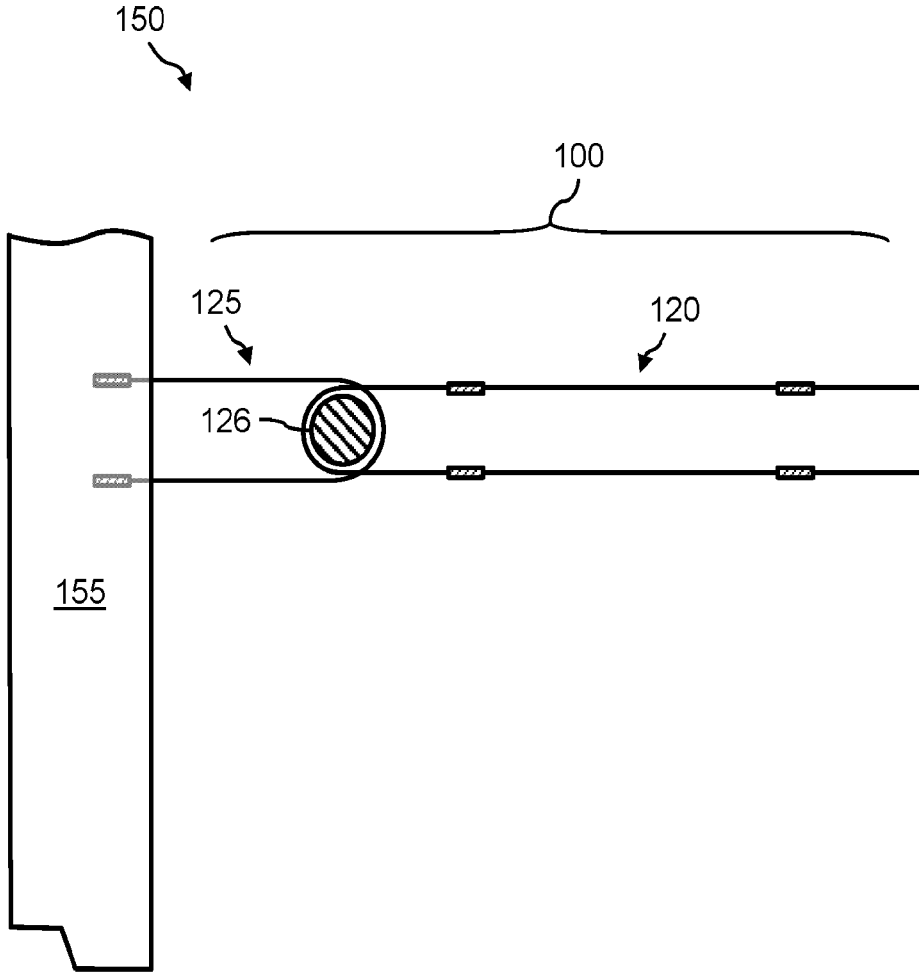

In yet another example, FIG. 13 shows the double layer of discrete soil reinforcing members 100 may be connected to a singular geogrid section 125 that is cast into wall panel 155. The double layer of discrete soil reinforcing members 100 is then connected on each side with a tubular connection 126. A singular geogrid section 125 may be preferable for economic reasons. The tubular connection 126 must have a diameter sufficiently large to allow singular geogrid section 125 and, for example, multi-section reinforcing member 120 to wrap around tubular connection 126 without a decrease in strength of the reinforcement. Tube diameters of approximately 2 inches or larger are desired. This connection has the advantage that it allows a connection between two soil reinforcing members 100 that does not require interleaving the strips 114. This connection is advantageous because it reduces the slack in the connection.

Figure 14:
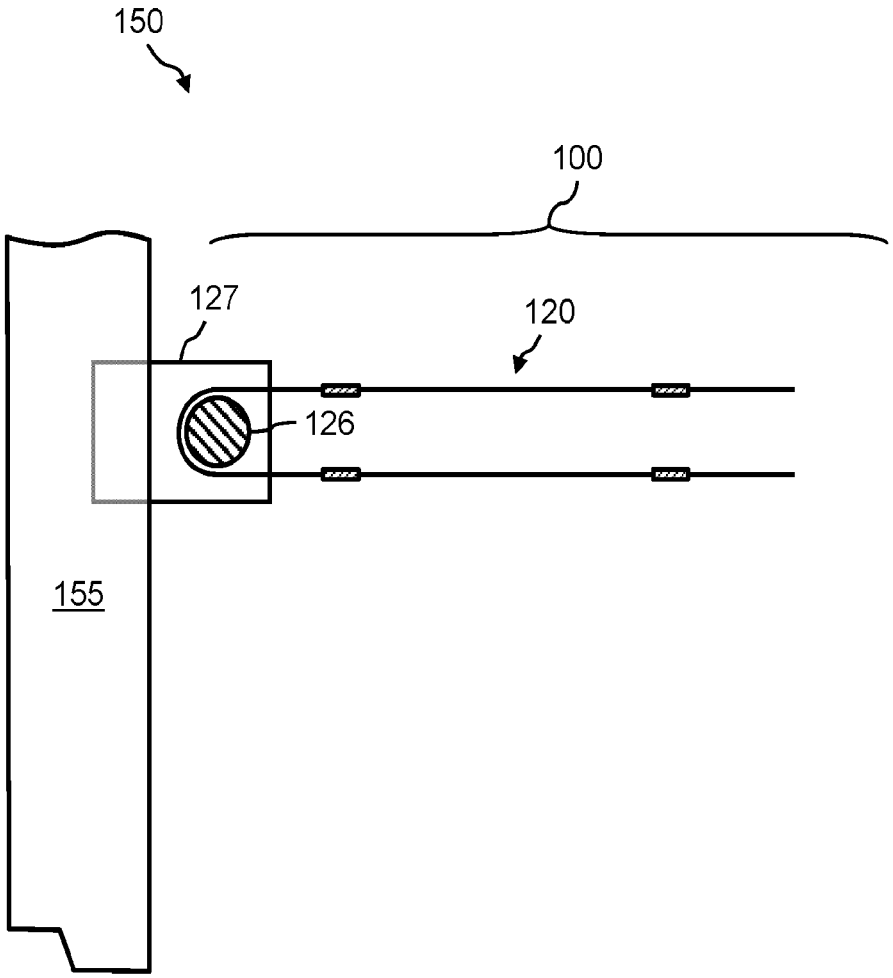

In yet another example, FIG. 14 shows the double layer of discontinuous soil reinforcing members 100 may be wrapped around a protruding connection device 127 that is embedded or otherwise attached to wall panel 155. The double layer of discontinuous soil reinforcing members 100 may be connected to the connection device 127 with tubular connection 126 or similar.

Figure 15:
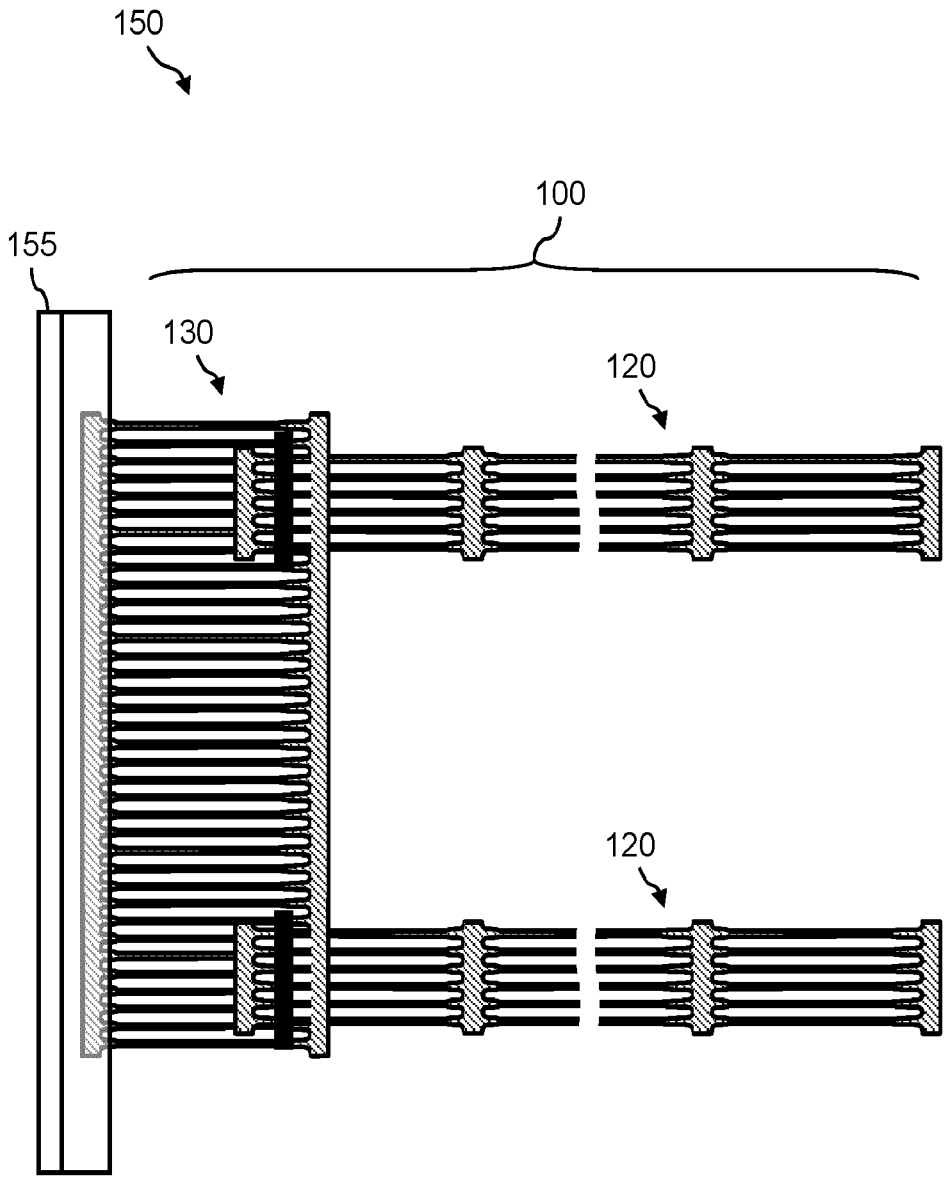

In yet another example, FIG. 15 shows the connection of the discontinuous multi-section reinforcing members 120, whether single layers or double layered, to wall panel 155 can be accomplished by attaching the discontinuous multi-section reinforcing members 120 to a wide-width reinforcing member 130 cast into wall panel 155. The connections are made with Bodkin connection bars 135 of such a width as to extend slightly beyond the width of the discontinuous multi-section reinforcing members 120. Connecting the discrete multi-section reinforcing members 120 to wide-width reinforcing member 130 (i.e., a wide width continuous segment of geogrid) may be preferable as it enables onsite location of the discontinuous multi-section reinforcing members 120 to avoid obstructions behind wall panel 155 without the need for specialty facing panels with variations in the horizontal location of the end tabs, such as end tabs 112.

The presently disclosed subject matter also provides a device for and method of tensioning the discrete soil reinforcing members 100 and the connection therebetween within the backfill. For example, FIG. 16 shows a perspective view of an example of a tensioning device 200 for tensioning the discrete soil reinforcing members 100 of the presently disclosed geosynthetic reinforced wall panels 150. Tensioning device 200 includes a main bar 210, a handle bar 212, and a tensioning bar 214. Optionally, the lower end of main bar 210 has a pointed tip 216. Handle bar 212 is arranged in T-fashion at the upper end of main bar 210. Tensioning bar 214 is typically arranged in T-fashion at the middle or lower portion of main bar 210. In one example, multiple through-holes 218 are provided along the length of main bar 210 for receiving tensioning bar 214. In this way, the position of tensioning bar 214 can be adjustable. Main bar 210, handle bar 212, and tensioning bar 214 can be hollow or solid bars and can have a circular or rectangular cross-section. Tensioning device 200 is of such a height and geometry to allow for easy handling and use.

Referring now to FIG. 17A and FIG. 17B is side views of an example of using tensioning device 200 of FIG. 16. Namely, FIG. 17A shows two layers of discrete soil reinforcing members 100 that includes a loop of multi-section reinforcing member 120 connecting to the pair of single-section reinforcing members 110 via Bodkin connection bars 135. Tensioning device 200 is driven into the ground at the loop portion of multi-section reinforcing member 120. Namely, handle bar 212 of tensioning device 200 is angled toward wall panel 155 and then pointed tip 216 is driven into reinforced backfill 160 at a depth sufficient so as to allow for leveraging of the tensioning device 200 backwards away from wall panel 155. Then, the loop portion of multi-section reinforcing member 120 is wrapped around tensioning bar 214 of tensioning device 200. Then, and referring now to FIG. 17B, tensioning device 200 is leveraged backwards away from wall panel 155. This action results in the removal of slack from the Bodkin bar connections of, for example, the two single-section reinforcing members 110 and the multi-section reinforcing member 120.

In another example, FIG. 18 shows a single layer of discrete soil reinforcing members 100 that includes a single-section reinforcing member 110 connected to another configuration of multi-section reinforcing member 120, wherein multi-section reinforcing member 120 has a loop 132 at one end. In this example, loop 132 is wrapped around tensioning bar 214 of tensioning device 200 and then tensioning device 200 is leveraged backwards away from wall panel 155. Again, this action results in the removal of slack at the Bodkin bar connection. In FIG. 17A and FIG. 17B and/or FIG. 18, once tensioned, the single layer or double layers of discrete soil reinforcing members 100 is backfilled to hold tension on wall panel 155 wherein the strips 114 are designed to engage with the backfill. Then, tensioning device 200 can either be removed or left in place within the reinforced backfill.

Referring now to FIG. 19 is a back view and side view of geosynthetic reinforced wall panel 150 in combination with a panel stabilizing device 300. For example, panel stabilizing device 300 includes a corrugated member 310, one end of which is mechanically fastened to the top portion of wall panel 155 via a bracket 312 and a pin or bolt 314, wherein a portion of bracket 312 is embedded or cast into wall panel 155 as shown. The lower end of corrugated member 310 is angled away from wall panel 155 and then held by a length of multi-section reinforcing member 120. For example, a certain length of multi-section reinforcing member 120 is provided in a loop that extends from the back of wall panel 155, where the two end tabs 112 are embedded into wall panel 155 (and thereby perpendicular to reinforcing members 120 that are horizontal with the ground surface and making contact with rearward soil). The lower end of corrugated member 310 is fitted into the loop portion of multi-section reinforcing member 120, thereby securing corrugated member 310 at an angle with respect to wall panel 155.

The presence of corrugated member 310 in panel stabilizing device 300 provides resistance to panel rotation. Namely, the corrugations in corrugated member 310 interact with the surrounding soil to provide resistance to panel rotation. As wall panel 155 is backfilled layer by layer, wall panel 155 begins to be loaded laterally by these soil lifts. The outwards rotation of wall panel 155 is resisted by the soil reinforcing members 100. However, panel stabilizing device 300 provides additional rotation resistance via the interaction with the surrounding soil during the backfill placement process until the upper layers of soil reinforcing members 100 are engaged within the backfill. After the upper layers of soil reinforcing members 100 engaged in the backfill layer, the bolted or pinned connection may be removed and corrugated member 310 may be removed for reuse or left in place in the backfill. The use of panel stabilizing device 300 is preferable because it limits the number of layers of soil reinforcing members 100 required to stabilize a wall panel 155 during the construction process.

In summary and referring again to FIG. 1 through FIG. 19, geosynthetic reinforced wall panel 150 features (a) discrete strips of HDPE or PET soil reinforcing members 100, connected to a retaining wall facing element, such as a precast wall panel 155 or similar, (b) more efficient and better performing connections (e.g., the Bodkin bar connections), (c) a device and methods of tensioning (e.g., tensioning device 200) the discrete soil reinforcing members 100 within the backfill, and (d) a device (e.g., panel stabilizing device 300) and method for stabilizing a retaining wall facing element, such as a precast wall panel 155 or similar. Construction stability is improved through the full engagement of the soil reinforcing members 100 to placement of backfill against the retaining wall facing element, such as a precast wall panel 155 or similar.

Referring now to FIG. 20 is a front view of an example of a retaining wall system 400 that includes any arrangement of one or more geosynthetic reinforced wall panels 150 that are supported by any arrangement of soil reinforcing members 100.

EXAMPLES

Example 1

Referring now to FIG. 21 is a plot 500 indicating the results of laboratory testing that demonstrates the relative tightness or amount of "connection slack" removed using soil reinforcing members 100 (e.g., single-section reinforcing members 110, multi-section reinforcing members 120, and wide-width reinforcing member 130). The narrow-width discrete HDPE soil reinforcing members 100 (e.g., single-section reinforcing members 110 and multi-section reinforcing members 120) are able to develop tighter and more robust connections than wide width HDPE sheet type soil reinforcement.

Plot 500 of FIG. 21 shows two connection displacement curves, a curve 510 and a curve 512. The connection displacement curve 510 for the presently disclosed geosynthetic reinforced wall panels 150 that include soil reinforcing members 100 is shown by the nonlinear response. During initial applications of applied load, relatively high deformations are achieved. Once a load of approximately 550 lb/ft is applied, incremental deformations are much smaller. The connection displacement curve 512 for the sheet geogrid is relatively linear and results in smaller deformations than noted for the response of the current invention at all load levels until approximately 400 lb/ft. While it may appear that a stiffer initial response (i.e., the sheet response) would be advantageous, this is in practice not the case. In practice, geogrid reinforcing elements are hand tensioned during placement prior to full wall backfill loads applied. The response of the current invention is advantageous because it is much easier to get the slack out of the connection during pre-tensioning. Thus, the system "starts" along a curve that has a steep (small incremental deformation per incremental load) response resulting in smaller panel deflection. Because the prior art response is more difficult to pre-tension, it is in practice not tensioned as much. Thus, when the wall backfill is applied, relatively larger deformations are noted as the slack in the connection is overcome.

Additionally, the presently disclosed geosynthetic reinforced wall panels 150 that include soil reinforcing members 100 is advantageous to the prior art because the ability to apply a 400 lb/ft load uniformly across a full sheet of soil reinforcement greater than 4 feet in width (1,600 lb plus total load) is more challenging than a 400 lb/ft load uniformly applied over approximately 8 inches (a total applied load of approximately 270 lbs). Displacing the slack in the discrete soil reinforcing element connection is easier than that of the sheet type of soil reinforcement.

Further, because, for example, single-section reinforcing members 110 and multi-section reinforcing members 120 are of relatively narrow width, the skew of the transverse rib has little influence when the Bodkin connection (e.g., using Bodkin connection bar 135) is engaged. This results in significantly less "slack" in the connection and provides greatly enhanced wall stiffness during construction. It is possible for the connection of the sheet soil reinforcement (e.g., wide-width reinforcing member 130) to reach the same level of connection tightness as the discrete strip soil reinforcement connection (e.g., of single-section reinforcing members 110 and multi-section reinforcing members 120). However, due to the larger width of the connection components, minor variations across the wider width affect the ability to tighten the full connection to the same level as the discrete strips.

Example 2

Referring now to FIG. 22 is illustrations showing a wide-width reinforcing member and discrete strips of soil reinforcing members installed for a test wall site. For example, illustration 600 shows a wide-width member (e.g., wide-width reinforcing member 130) and discrete strips of soil reinforcing members 100 (e.g., single-section reinforcing members 110 and multi-section reinforcing members 120) installed for a test wall site. As shown in the illustrations, the sheet of soil reinforcement requires the backfill be placed against the rear side of the facing panel prior to the connection being made. This results in the panel being loaded with lateral earth pressure prior to the soil reinforcing element becoming engaged and capable of withstanding that load. FIG. 22 also shows an illustration 610 of the discrete soil reinforcing members 100 (e.g., single-section reinforcing members 110 and multi-section reinforcing members 120) installed for the same test wall site. The discrete elements allow for the reinforcing element to be engaged within the backfill prior to lateral pressure being placed against the wall face.

Referring now to FIGS. 23Ai, 23Aii, 23Bi and 23Bii is various plots 700 showing the results of a panel wall movement survey using full-width sheet soil reinforcing elements and walls built using the presently disclosed geosynthetic reinforced wall panels 150 that include soil reinforcing members 100. It is known and accepted within the industry that the soil mass being reinforced must move slightly to mobilize the soil reinforcing elements. Plots 700 of FIGS. 23Aii and 23Bii show the difference in the mobilized movement for the discrete soil reinforcing members 100 compared to that for the sheet of soil reinforcing. As shown in FIGS. 23 Ai, 23Aii, 23Bi and 23Bii, the wall built using the geosynthetic reinforced wall panels 150 yielded approximately half the panel movement during construction compared to the sheet of soil reinforcing.

Example 3

Table 1 and Table 2 and FIG. 24 show that double layers of discrete soil reinforcing members 100 (e.g., see FIG. 7) provide increased geogrid to soil interaction than those of the single layer sheet soil reinforcing elements. The Coefficient of Interaction, Ci, is the applied shear load normalized by the product of the area of the geosynthetic and the tangent of the friction angle of the soil and the normal stress acting on the geosynthetic. Table 1 and Table 2 show the conditions of the pullout testing for the discrete soil reinforcing members 100 as well as those of the sheet soil reinforcement.

TABLE 1

Discrete Soil Reinforcing Members 100

| Test No. | Test Specimen Width (in.) | Embedment Length (in.) | Normal Stress (psf) | Maximum Pullout Resistance (lb/ft) | Coefficient of Interaction $C_i = \frac{P_{max}}{2WL(\sigma_n \tan\phi + c)}$ |
|---|---|---|---|---|---|
| 1A | 7.5 | 40 | 200 | 1151 | 1.67 |
| 1B | 7.5 | 40 | 1000 | 5824 | 2.29 |
| 1C | 7.5 | 40 | 1500 | 7952 | 2.15 |
| 1D | 7.5 | 40 | 2000 | 7658 | 1.58 |
| 1E | 7.5 | 40 | 2500 | 8023 | 1.34 |

Residual Soil Shear Strength: 29 degree phi angle, 55 psf c

TABLE 2

Sheet Soil Reinforcement

| Test No. | Test Specimen Width (in.) | Embedment Length (in.) | Normal Stress (psf) | Maximum Pullout Resistance (lb/ft) | Coefficient of Interaction $C_i = \frac{P_{max}}{2WL(\sigma_n \tan\phi + c)}$ |
|---|---|---|---|---|---|
| 2A | 17 | 55.5 | 288 | 1479 | 0.76 |
| 2B | 17 | 55.5 | 864 | 2973 | 0.62 |

Residual Soil Shear Strength: 28 degree phi angle, 55 psf c

Referring now to FIG. 24 is a plot 800 indicating the Ci values of the two soil reinforcing types (i.e., soil reinforcing members 100 and the sheet soil reinforcement) for comparison. The Ci values of the double layers of discrete soil reinforcing members 100 (e.g., see FIG. 7) are measured to be more than twice the Ci values of the single layer sheet reinforcing elements with comparable loading and soils because the discrete strips combine to act upon a greater three dimensional area than the corresponding sheet soil reinforcement at similar loading and soil conditions. The presently disclosed geosynthetic reinforced wall panels 150 that include soil reinforcing members 100 provides improvement to the sheet type of soil reinforcement because increasing the soil and geosynthetic reinforcing element interaction improves the wall performance and enables a reduction of the quantity of soil reinforcing elements required to stabilize the wall resulting in beneficial construction methods.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A retaining wall system comprising:

(a) a retaining wall facing element, the retaining wall facing element comprising a plurality of embedded retaining wall connectors comprising discrete first geogrid sections;

(b) a plurality of tension connectors in communication with the embedded connector first geogrid sections;

(c) a plurality of soil reinforcing members comprising discrete second geogrid sections in communication with the tension connectors;

(d) a tensioning device for tensioning the embedded retaining wall connectors and the soil reinforcing second geogrid sections during backfill material placement, the tensioning device comprising a main bar, a handle bar disposed on an upper end of the main bar, and a tensioning bar disposed on the main bar; and, (e) a facing element stabilizing device comprising an angled corrugated section connected to the facing element to provide resistance to facing element rotation during backfill material placement, and wherein the upper end of the main bar is spaced apart from the retaining wall to enable use of the main bar as a lever for applying tensioning force to the embedded retaining wall connectors and the soil reinforcing second geogrid sections.

2. The system of claim 1, wherein the retaining wall facing element is a precast concrete panel.

3. The system of claim 1, wherein the embedded connector first geogrid sections and the soil reinforcing second geogrid sections comprise a corrosion-resistant material that is substantially inert to chemical degradation.

4. The system of claim 3, wherein the corrosion-resistant material that is substantially inert to chemical degradation comprises high-density polyethylene (HDPE).

5. The system of claim 1, wherein the tension connectors comprise a corrosion-resistant material that is substantially inert to chemical degradation.

6. The system of claim 5, wherein the material that is substantially inert to chemical degradation comprises HDPE.

7. The system of claim 1, wherein the tension connectors comprise a bodkin connector.

8. The system of claim 1, wherein the tension connectors comprise a tubular connector.

9. The system of claim 1, wherein the embedded connector first geogrid sections comprise multiple layers.

10. The system of claim 1, wherein the soil reinforcing second geogrid sections comprise multiple layers.

11. The system of claim 1, wherein the facing element stabilizing device is removably connected to the facing element through a bolted or pinned connection.

12. A retaining wall system comprising:

(a) a retaining wall facing element, the retaining wall facing element comprising an embedded retaining wall connector comprising a first continuous geogrid section;

(b) a plurality of tension connectors in communication with the embedded connector first continuous geogrid section;

(c) a plurality of soil reinforcing members comprising discrete second geogrid sections in communication with the tension connectors;

(d) a tensioning device for tensioning the embedded retaining wall connector and the soil reinforcing second geogrid sections during backfill material placement, the tensioning device comprising a main bar, a handle bar disposed on an upper end of the main bar, and a tensioning bar disposed on the main bar; and (e) a facing element stabilizing device comprising an angled corrugated section connected to the facing element to provide resistance to facing element rotation during backfill material placement, and wherein the upper end of the main bar is spaced apart from the retaining wall to enable use of the main bar as a lever for applying tensioning force to the embedded retaining wall connectors and the soil reinforcing second geogrid sections.

13. The system of claim 12, wherein the retaining wall facing element is a precast concrete panel.

14. The system of claim 12, wherein the embedded connector first continuous geogrid section and the soil reinforcing second geogrid sections comprise a corrosion-resistant material that is substantially inert to chemical degradation.

15. The system of claim 14, wherein the corrosion-resistant material that is substantially inert to chemical degradation comprises HDPE.

16. The system of claim 12, wherein the tension connectors comprise a corrosion-resistant material that is substantially inert to chemical degradation.

17. The system of claim 16, wherein the material that is substantially inert to chemical degradation comprises HDPE.

18. The system of claim 12, wherein the tension connectors comprise a bodkin connector.

19. The system of claim 12, wherein the tension connectors comprise a tubular connector.

20. The system of claim 12, wherein the embedded connector first continuous geogrid section comprises multiple layers.

21. The system of claim 12, wherein the soil reinforcing second geogrid sections comprise multiple layers.

22. The system of claim 12, wherein the facing element stabilizing device is removably connected to the facing element through a bolted or pinned connection.

23. A method for reinforcing a retaining wall component comprising:

(a) positioning a retaining wall facing element in a predetermined location, the retaining wall facing element comprising a plurality of embedded retaining wall connectors comprising discrete first geogrid sections;

(b) connecting the embedded connector first geogrid sections to a plurality of tension connectors;

(c) providing a plurality of soil reinforcing members comprising discrete second geogrid sections;

(d) connecting the embedded connector first geogrid sections to the soil reinforcing second geogrid sections via the tension connectors;

(e) placing an amount of backfill material onto the embedded connector first geogrid sections and the soil reinforcing second geogrid sections;

(f) compacting the backfill material onto the embedded connector first geogrid sections and the soil reinforcing second geogrid sections;

(g) providing a predetermined tensioning force to the soil reinforcing second geogrid sections;

(h) tensioning the embedded connector first geogrid sections and the soil reinforcing second geogrid sections using a tensioning device as a lever by moving an upper end of the tensioning device away from the retaining wall;

(i) providing resistance to rotation of the retaining wall facing element during backfill material placement using a facing element stabilizing device comprising an angled corrugated section connected to the facing element, and wherein the tensioning device comprises a main bar, a handle bar disposed on the upper end of the main bar, and a tensioning bar disposed on the main bar, and wherein the upper end of the main bar is spaced apart from the retaining wall to enable use of the main bar as a lever for applying tensioning force to the embedded retaining wall connectors and the soil reinforcing second geogrid sections.

24. A method for reinforcing a retaining wall component comprising:

(a) positioning a retaining wall facing element in a predetermined location, the retaining wall facing element comprising an embedded retaining wall connector comprising a first continuous geogrid section;

(b) connecting the embedded connector first continuous geogrid section to a plurality of tension connectors;

(c) providing a plurality of soil reinforcing members comprising discrete second geogrid sections;

(d) connecting the embedded connector first continuous geogrid section to the soil reinforcing second geogrid sections via the tension connectors;

(e) placing an amount of backfill material onto the embedded connector first continuous geogrid section and the soil reinforcing second geogrid sections;

(f) compacting the backfill material onto the embedded connector first continuous geogrid section and the soil reinforcing second geogrid sections;

(g) providing a predetermined tensioning force to the soil reinforcing second geogrid sections; and (h) tensioning the embedded connector first geogrid sections and the soil reinforcing second geogrid sections using a tensioning device as a lever by moving an upper end of the tensioning device away from the retaining wall;

(i) providing resistance to rotation of the retaining wall facing element during backfill material placement using a facing element stabilizing device comprising an angled corrugated section connected to the facing element, and, wherein the tensioning device comprises a main bar, a handle bar disposed on the upper end of the main bar, and a tensioning bar disposed on the main bar, and wherein the upper end of the main bar is spaced apart from the retaining wall to enable use of the main bar as a lever for applying tensioning force to the embedded retaining wall connectors and the soil reinforcing second geogrid sections.

* * * * *